US007025839B2

(12) United States Patent
Lumley et al.

(10) Patent No.: US 7,025,839 B2
(45) Date of Patent: Apr. 11, 2006

(54) HEAT TREATMENT OF AGE-HARDENABLE ALUMINUM ALLOYS

(75) Inventors: Roger Neil Lumley, Clayton South (AU); Ian James Polmear, Mont Albert North (AU); Allan James Morton, Glen Iris (AU)

(73) Assignee: Commonwealth Scientific and Industrial Research Organization, Territory (AU)

( * ) Notice: Subject to any disclaimer, the term of this patent is extended or adjusted under 35 U.S.C. 154(b) by 325 days.

(21) Appl. No.: 10/172,365

(22) Filed: Jun. 14, 2002

(65) Prior Publication Data

US 2003/0041934 A1 Mar. 6, 2003

Related U.S. Application Data

(63) Continuation of application No. PCT/AU00/01601, filed on Dec. 21, 2000.

(30) Foreign Application Priority Data

Dec. 23, 1999 (AU) ..... PQ4853

(51) Int. Cl.
*C22F 1/04* (2006.01)

(52) U.S. Cl. ..... 148/698; 148/690; 148/693; 148/694; 148/697

(58) Field of Classification Search ..... 148/690, 148/693, 694, 695, 697–702
See application file for complete search history.

(56) References Cited

U.S. PATENT DOCUMENTS

| | | | | |
|---|---|---|---|---|
| 5,076,859 A | | 12/1991 | Rioja et al. | |
| 5,108,520 A | | 4/1992 | Liu et al. | |
| 5,690,758 A | | 11/1997 | Oh et al. | 148/700 |
| 5,858,134 A | | 1/1999 | Bechet et al. | 148/550 |
| 5,879,481 A | | 3/1999 | Price | 148/698 |
| RE36,692 E | * | 5/2000 | Gupta et al. | 148/694 |

FOREIGN PATENT DOCUMENTS

| | | | |
|---|---|---|---|
| TW | 297839 | | 5/1984 |
| TW | 297839 A | * | 2/1997 |
| WO | 87/00206 | | 1/1987 |
| WO | 92/18658 | | 10/1992 |
| WO | 95/24514 | | 9/1995 |
| WO | 96/18752 | | 6/1996 |

OTHER PUBLICATIONS

"Aluminum and Aluminum Alloys", ASM International, 1993, p 314.*
"ASM Handbook: vol. 4 Heat treating", ASM International, 1991, p. 845-850.*

(Continued)

*Primary Examiner*—George Wyszomierski
*Assistant Examiner*—Janelle Morillo

(57) ABSTRACT

The heat treatment of an age-hardenable aluminium alloy, having alloying elements in solid solution includes the stages of holding the alloy for a relatively short time at an elevated temperature $T_A$ appropriate for ageing the alloy; cooling the alloy from the temperature $T_A$ at a sufficiently rapid rate and to a lower temperature so that primary precipitation of solute elements is substantially arrested; holding the alloy at a temperature $T_B$ for a time sufficient to achieve a suitable level of secondary nucleation or continuing precipitation of solute elements; and heating the alloy to a temperature which is at, sufficiently close to, or higher than temperature $T_A$ and holding for a further sufficient period of time at temperature $T_C$ for achieving substantially maximum strength.

29 Claims, 21 Drawing Sheets

OTHER PUBLICATIONS

Gerlach, R, and H. Löffler. Development of the Microhardness of an AL-2.0 at .% Zn-1.3 at .% Mg Alloy with Additions of Technical Impurities during a Two-step Ageing Treatment(II). *Crystal Res. & Technol.*(1982) 17(2) pp 267-273.

Bartuška, P. et al. "On the Room Temperature Stability of Metastable Phases Formed at 200° C in Al-Zn Alloys," *Phys. Stat. Sol*, (1979) 55, pp 673-679.

Löffler, H. et al. "Decomposition processes in Al-Zn-Mg Alloys." *Journal of Materials Science*, (1983) 18, pp 2215-2240.

Wendrock, G. and H. Löffler. "Two-Step Ageing Treatments as a Means to Estimate the Zinc Content of Guinier-Preston Zones at Elevated Temperatures in an Al-15 at %Zn Alloy." . *Phys. Stat. Sol.*, (1985) 90, pp 483-487.

Löffler, Hans, "Sequence of Phases during Isothermal Ageing", Chapter 3, pp. 250-266, References, pp. 475-481. *Structure and Structure Development of Al-Zn Alloys*. Akademie Verlag GmbH, Berlin. (1995).

Pashley, D.W. et al. "Th Basic Proc sses Aff cting Two-St p Ageing in an Al-Mg-Si Alloy." *Philosophical Magazine*, (1967) pp 51-76.

English translation of Taiwan Patent No. 297839 dated May 2, 1984.

"Aluminum Standards and Data 1998 Metric Sl", The Aluminum Association. Apr. 1998, pp. 3-12 to 3-17.

"International Alloy Designations and Chemical Composition Limits for Wrought Aluminum and Wrought Aluminum Alloys." *Unified North American and International Registration Records, The Aluminum Association.* Jul. 1998.

Silcock, J.M. et al. "Structural Ageing Characteristics of Binary Aluminum-Copper Alloys." *J. Institute of Metals.* (1953), 82: 239-248.

Lumley, R. N. et al. "Control of Secondary Precipitation to Improve the Performance of Aluminum Alloys." *Materials Science Forum*, (2002), vols. 396-402, pp. 893-898. Copyright 2002, Trans Tech Publications, Switzerland.

Altenpohl, Dietrich G. *Aluminum: Technology, Applications, and Environment. A Profile of a Modern Metal.* Sixth Edition. 1998. The Aluminum Association, Washington, D.C. and The Minerals, Metals & Materials Society, Warrendale, Pennsylvania, pp. 220-224.

Derwent Abstract Accession No. 85-033647/06 JP 59226197 dated Dec. 19, 1994.

Derwent Abstract Accession No. 83-36612K/15 SU 933789 dated Jun. 7, 1982.

Pashley, D.W., et al. "Delayed Ageing in Aluminum-Magnesium-Silicon Alloys: Effect on Structure and Mechanical Properties" Journal of the Institute of Metals (1986) vol. 94 pp 41-49.

Pashley, D.W., et al. "The Basic Processes Affecting Two-step Ageing in an Al-Mg-Si Alloy" (1967) pp 51-76.

* cited by examiner

T6

×100k

T6I6

Alloy 357, T6 &T616

⇐T6I6
⇐T6
Load in KN
4
3
2
1
0
1
2
3
Displacement in mm

HEAT TREATMENT OF AGE-HARDENABLE ALUMINUM ALLOYS

This is a continuation of application No. PCT/AU00/01601, filed Dec. 21, 2000.

This invention relates to the heat treatment of aluminium alloys, that are able to be strengthened by the well known phenomenon of age (or precipitation) hardening.

Heat treatment for strengthening by age hardening is applicable to alloys in which the solid solubility of at least one alloying element decreases with decreasing temperature. Relevant aluminium alloys include some series of wrought alloys, principally those of the 2XXX, 6XXX and 7XXX (or 2000, 6000 and 7000) series of the International Alloy Designation System (IADS). However, there are some relevant age-hardenable aluminium alloys which are outside these series. Also, some castable aluminium alloys are age hardenable. The present invention extends to all such aluminium alloys, including both wrought and castable alloys, and also can be used with alloy products produced by processes such as powder metallurgy and with rapidly solidified products, as well as with particulate reinforced alloy products and materials.

Processes for heat treatment of age-hardenable aluminium alloys normally involve the following three stages:

(1) solution treatment at a relatively high temperature, below the melting point of the alloy, to dissolve its alloying (solute) elements;

(2) rapid cooling, or quenching, such as into cold water, to retain the solute elements in a supersaturated solid solution; and (3) ageing the alloy by holding it for a period of time at one, sometimes at a second, intermediate temperature, to achieve hardening or strengthening.

The strengthening resulting from ageing occurs because the solute, retained in supersaturated solid solution by quenching, forms precipitates during the ageing which are finely dispersed throughout the grains and which increase the ability of the alloy to resist deformation by the process of slip. Maximum hardening or strengthening occurs when the ageing treatment leads to formation of a critical dispersion of at least one of these fine precipitates.

Ageing conditions differ for different alloy systems. Two common treatments which involve only one stage are to hold for an extended time at room temperature (T4 temper) or, more commonly, at an elevated temperature for a shorter time (for example 8 hours) which corresponds to a maximum in the hardening process (T6 temper). For certain alloys, it is usual to hold for a prescribed period of time (for example 24 hours) at room temperature before applying the T6 temper at an elevated temperature. In other alloys, notably those based on the Al—Cu and Al—Cu—Mg systems (of the 2000 series), deformation (for example by stretching or rolling 5%) after quenching and before ageing at an elevated temperature, causes an increased response to strengthening. This is known as a T8 temper and it results in a finer and more uniform dispersion of precipitates throughout the grains.

For alloys based on the Al—Zn—Mg—Cu system (of the 7000 series) several special ageing treatments have been developed which involve holding for periods of time at two different elevated temperatures. The purpose of each of these treatments is to reduce the susceptibility of alloys of this series to the phenomenon of stress corrosion cracking. One example is the T73 temper which involves ageing first at a temperature close to 100° C. and then at a higher temperature, e.g. 160° C. This treatment causes some reduction in strength when compared to a T6 temper. Another example is the treatment known as retrogression and re-ageing (RRA) which involves three stages, for example 24 hours at 120° C., a much shorter time at a higher temperature (200–280° C.) and a further 24 hours at 120° C. Some such treatments tend to remain confidential to companies that supply the alloys.

It is generally accepted that, once an aluminium alloy (or other suitable material) is hardened by ageing at an elevated temperature, the mechanical properties remain stable when the alloy is exposed for an indefinite time at a significantly lower temperature. However, recent results have shown that this is not always the case. A magnesium alloy, WES4, which is normally aged at 250° C. to achieve its T6 temper, has shown a gradual increase in hardness together with an unacceptable decrease in ductility if subsequently exposed for long periods at a temperature close to 150° C. This effect is attributed to slow, secondary precipitation of a finely dispersed phase throughout the grains of the alloy. More recently certain lithium-containing aluminium alloys, such as 2090 (Al-2.7 Cu-2.2 Li), have shown similar behaviour if exposed for long times at temperatures in the range 60 to 135° C., after being first aged to the T6 temper at 170° C.

The present invention is directed to providing a process for the heat treatment of an age-hardenable aluminium alloy which has alloying elements in solid solution, wherein the process includes the stages of:

(a) holding the alloy for a relatively short time at an elevated temperature $T_A$ appropriate for ageing the alloy;

(b) cooling the alloy from the temperature $T_A$ at a sufficiently rapid rate and to a lower temperature so that primary precipitation of solute elements is substantially arrested;

(c) holding the alloy at a temperature $T_B$ for a time sufficient to achieve a suitable level of secondary nucleation or continuing precipitation of solute elements; and (d) heating the alloy to a temperature $T_C$ which is at, sufficiently close to, or higher than temperature $T_A$ and holding for a further sufficient period of time at temperature $T_C$ for achieving substantially maximum strength.

This series of treatment stages in accordance with the present invention is termed T6I6, indicating the first ageing treatment before the stage (c) interrupt (I) and the treatment after the interrupt.

Stages (c) and (d) may be successive stages. In that case, there may be little or no applied heating in stage (c). However, it should be noted that stages (c) and (d) may be effectively combined through the use of appropriately controlled heating cycles. That is, stage (c) may utilise a heating rate, to the final ageing temperature $T_c$, which is sufficiently slow to provide the secondary nucleation or precipitation at relatively lower average temperature than the final ageing temperature $T_c$.

We have found that, with the heat treatment of the present invention, substantially all aluminium alloys capable of age hardening can undergo additional age hardening and strengthening to higher levels than are possible with a normal T6 temper. Maximum hardness can be increased such as by 10 to 15%, while yield strength (i.e. 0.2% proof stress) and tensile strength can be increased such as by 5 to 10% or, with at least some alloys, even higher, relative to levels obtainable with conventional T6 heat treatments. Moreover, at least in many cases and contrary to usual behaviour after conventional treatments, the increases obtainable with the present invention are able to be achieved without any significant decrease in ductility as measured by elongation occurring on testing alloys to failure.

As indicated, the process of the present invention enables alloys to undergo additional age hardening and strengthening to higher levels relative to the age hardening and strength obtainable for the same alloy subjected to a normal T6 temper. The enhancement can be in conjunction with mechanical deformation of the alloy before stage (a); after stage (b) but before stage (c); and/or during stage (c). The deformation may be by application of thermomechanical deformation; while deformation may be applied in conjunction to rapid cooling. The alloy may be aged in stage (a) directly after fabrication or casting with no solution treatment stage.

The process of the present invention is applicable not only to the standard T6 temper but also applicable to other tempers. These include such instances as the T5 temper, where the alloy is aged directly after fabrication with no solution treatment step and a partial solution of alloying elements is formed. Other tempers, such as the T8 temper, include a cold working stage. In the T8 temper the material is cold worked before artificial ageing, which results in an improvement of the mechanical properties in many aluminium alloys through a finer distribution of precipitates nucleated on dislocations imparted through the cold working step. The equivalent new temper is thus designated T8I6, following the same convention in nomenclature as the T6I6 temper. Another treatment involving a cold working step, again following the process of the present invention, is designated T9I6. In this case the cold working step is introduced after the first ageing period, $T_A$ and before the interrupt treatment at temperature $T_B$. After the interrupt treatment is completed, the material is again heated to the temperature $T_C$, again following the convention of the T6I6 treatment.

Similar parallels exist with temper designations termed T7X, as exemplified previously, where a decreasing integer of X refers to a greater degree of overageing. These treatments consist of a two step process where two ageing temperatures are used, the first being relatively low (e.g. 100° C.) and the second at a higher temperature of, for example, 160° C.–170° C. In applying the new treatment to such tempers, the final ageing temperature $T_C$ is thus in the range of the usual second higher temperatures of 160° C.–170° C., with all other parts of the treatment being equivalent to the T6I6 treatment. Such a temper is thus termed T8I7X when employing the new nomenclature It should also be noted that the new treatment can be similarly applied to a wide variety of existing tempers employing significantly differing thermomechanical processing steps, and is in no way restricted to those listed above.

The process of the invention has proved to be effective in each of the classes of aluminium alloys that are known to respond to age hardening. These include the 2000 and 7000 series mentioned above, the 6000 series (Al—Mg—Si), age hardenable casting alloys, as well as particulate reinforced alloys. The alloys also include newer lithium-containing alloys such as 2090 mentioned above and 8090 (Al-24 Li-1.3 Cu-0.9 Mg), as well as silver-containing alloys, such as, 2094, 7009 and experimental Al—Cu—Mg—Ag alloys.

The process of the invention can be applied to alloys which, as received, have been subjected to an appropriate solution treatment stage followed by a quenching stage to retain solute elements in supersaturated solid solution. Alternatively, these can form preliminary stages of the process of the invention which precede stage (a). In the latter case, the preliminary quenching stage can be to any suitable temperature ranging from $T_A$ down to ambient temperature or lower. Thus, in a preliminary quenching stage to attain the temperature $T_A$, the need for reheating to enable stage (a) can be avoided.

The purpose of the solution treatment, whether of the alloy as received or as a preliminary stage of the process of the invention, is of course to take alloying elements into solid solution and thereby enable age hardening. However, the alloying elements can be taken into solution by other treatments and such other treatments can be used instead of a solution treatment.

As will be appreciated, the temperatures $T_A$, $T_B$ and $T_C$ for a given alloy are capable of variation, as the stages to which they relate are time dependent. Thus, $T_A$ for example can vary with inverse variation of the time for stage (a). Correspondingly, for any given alloy, the temperatures $T_A$, $T_B$ and $T_C$ can vary over a suitable range during the course of the respective stage. Indeed, variation in $T_B$ during stage (c) is implicit in the reference above to stages (c) and (d) being effectively combined.

The temperature $T_A$ used in stage (a) for a given alloy can be the same as, or close to, that used in the ageing stage of a conventional T6 heat treatment for that alloy However, the relatively short time used in stage (a) is significantly less than that used in conventional ageing. The time for stage (a) may be such as to achieve a level of ageing needed to achieve from about 50% to about 95% of maximum strengthening obtainable by full conventional T6 ageing Preferably, the time for stage (a) is such as to achieve from about 85% to about 95% of that maximum strength.

For many aluminium alloys, the temperature $T_A$ most preferably is that used when ageing for any typical T6 temper. The relatively short time for stage (a) may be, for example, from several minutes to, for example, 8 hours or more, such as from 1 to 2 hours, depending on the alloy and the temperature $T_A$ Under such conditions, an alloy subjected to stage (a) of the present invention would be said to be underaged.

The cooling of stage (b) preferably is by quenching. The quenching medium may be cold water or other suitable media. The quenching can be to ambient temperature or lower, such as to about −10° C. However, as indicated, the cooling of stage (b) is to arrest the ageing which results directly from stage (a); that is, to arrest primary precipitation of solute elements giving rise to that ageing.

The temperatures $T_B$ and $T_C$ and the respective period of time for each of stages (c) and (d) are inter-related with each other. They also are inter-related with the temperature $T_A$ and the period of time for stage (a); that is, with the level of underageing achieved in stage (a). These parameters also vary from alloy to alloy. For many of the alloys, the temperature $T_B$ can be in the range of from about −10° C. to about 90° C., such as from about 20° C. to about 90° C. However for at least some alloys, a temperature $T_B$ in excess of 90° C., such as to about 120° C., can be appropriate.

The period of time for stage (c) at temperature $T_B$ is to achieve secondary nucleation or continuing precipitation of solute elements of the alloy. For a selected level of $T_B$, the time is to be sufficient to achieve additional sufficient strengthening. The additional strengthening, while still leaving the alloy significantly underaged, usually results in a worthwhile level of improvement in hardness and strength. The improvement can, in some instances, be such as to bring the alloy to a level of hardness and/or strength comparable to that obtainable for the same alloy by that alloy being fully aged by a conventional T6 heat treatment. Thus if, for example, the underaged alloy resulting from stage (a) has a hardness and/or strength value which is 80% of the value obtainable for the same alloy fully aged by a conventional T6 heat treatment, heating the alloy at $T_B$ for a sufficient period of time may increase that 80% value to 90%, or possibly even more.

The period of time for stage (c) may, for example, range from less than 8 hours at the lower end, up to about 500 hours or more at the upper end. Simple trials can enable determination of an appropriate period of time for a given alloy. However, a useful degree of guidance can be obtained for at least some alloys by determining the level of increase in hardness and/or strength after relatively short intervals, such as 24 and 48 hours, and establishing a curve of best fit for variation in such property with time. The shape of the curve can, with at least some alloys, give useful guidance of a period of time for stage (c) which is likely to be sufficient to achieve a suitable level of secondary strengthening.

The temperature $T_C$ used during stage (d) can be substantially the same as $T_A$. For a few alloys, $T_C$ can exceed $T_A$, such as by up to about 20° C. or even up to 50° C. (for example, for T6I7X treatment). However for many alloys it is desirable that $T_C$ be at $T_A$ or lower than $T_A$, such as 20° C. to 50° C., preferably 30 to 50° C., below $T_A$. Some alloys necessitate $T_C$ being lower than $T_A$, in order to avoid a regression in hardness and/or strength values developed during stage (c).

The period of time at temperature $T_C$ during stage (d) needs to be sufficient for achieving substantially maximum strength. In the course of stage (d), strength values and also hardness are progressively improved until, assuming avoidance of significant regression, maximum values are obtainable. The progressive improvement occurs substantially by growth of precipitates produced during stage (c). The final strength and hardness values obtainable can be 5 to 10% or higher and 10 to 15% or higher, respectively, than the values obtainable by a conventional T6 heat treatment process. A part of this overall improvement usually results from precipitation achieved during stage (c), although a major part of the improvement results from additional precipitation achieved in stage (d).

In order that the invention may more readily be understood, description now is directed to the accompanying drawings, in which.

Figure 1:
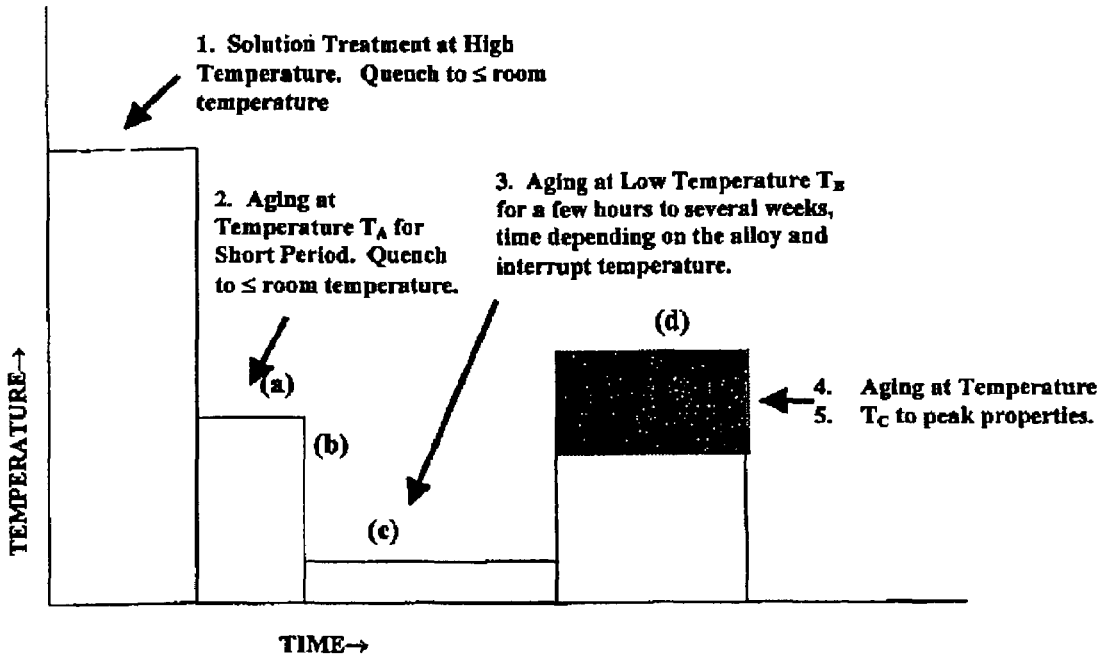
FIG. 1 is a schematic time-temperature graph illustrating an application of the process of the present invention.
Figure 2:
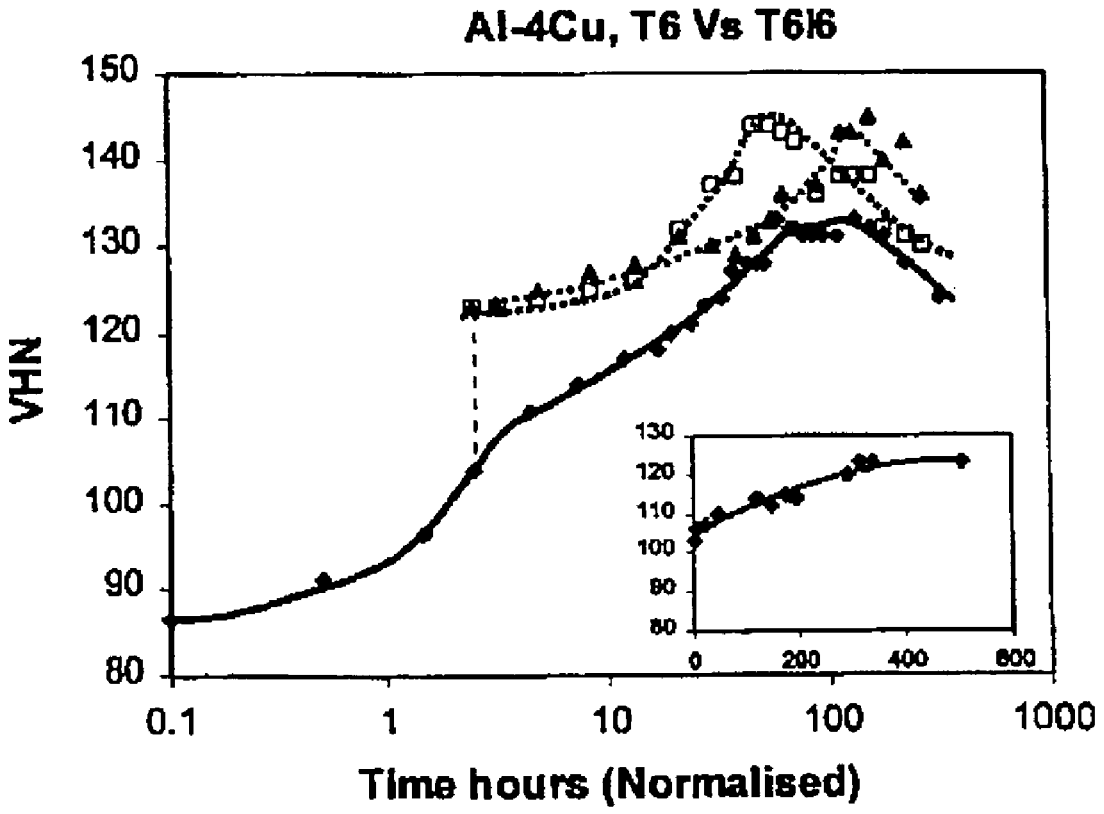
FIG. 2 is a plot of time against hardness, illustrating application of the process of the invention to Al-4Cu alloy, during T6I6 processing compared with a conventional T6 temper.
Figure 5:
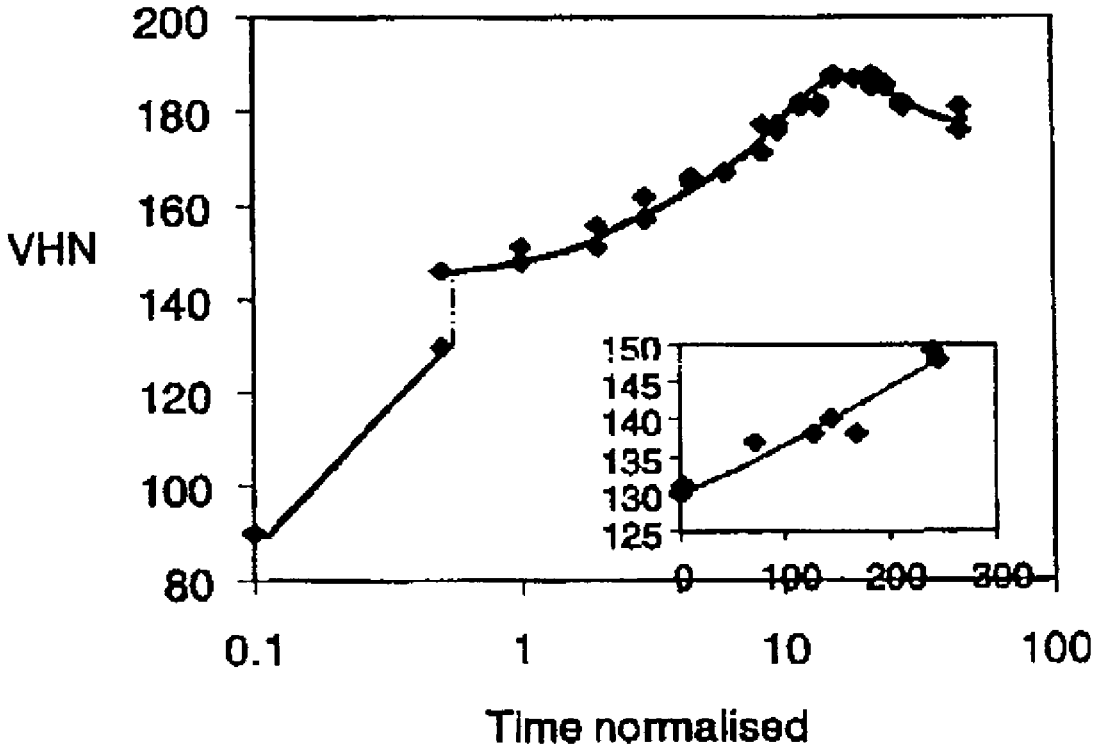
Figure 6:
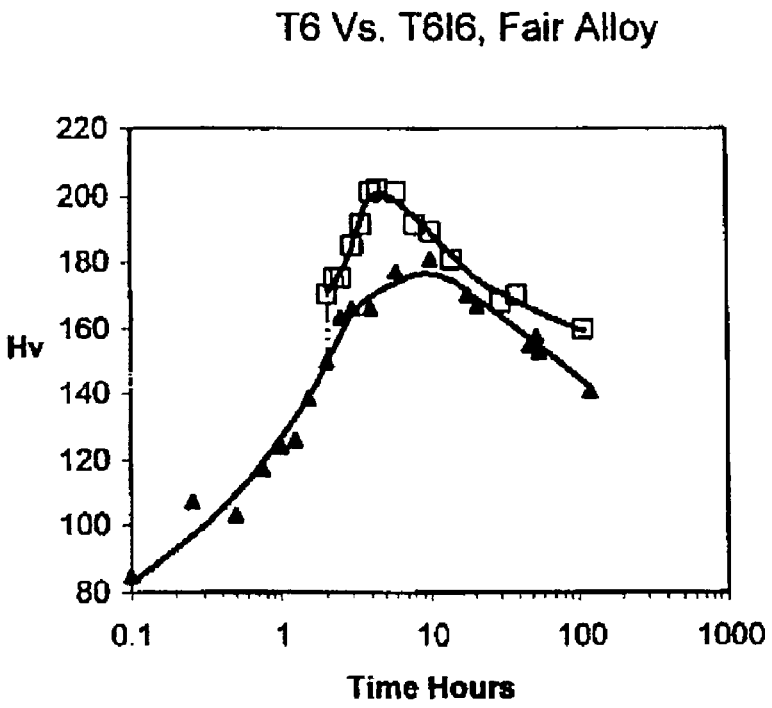
Figure 7:
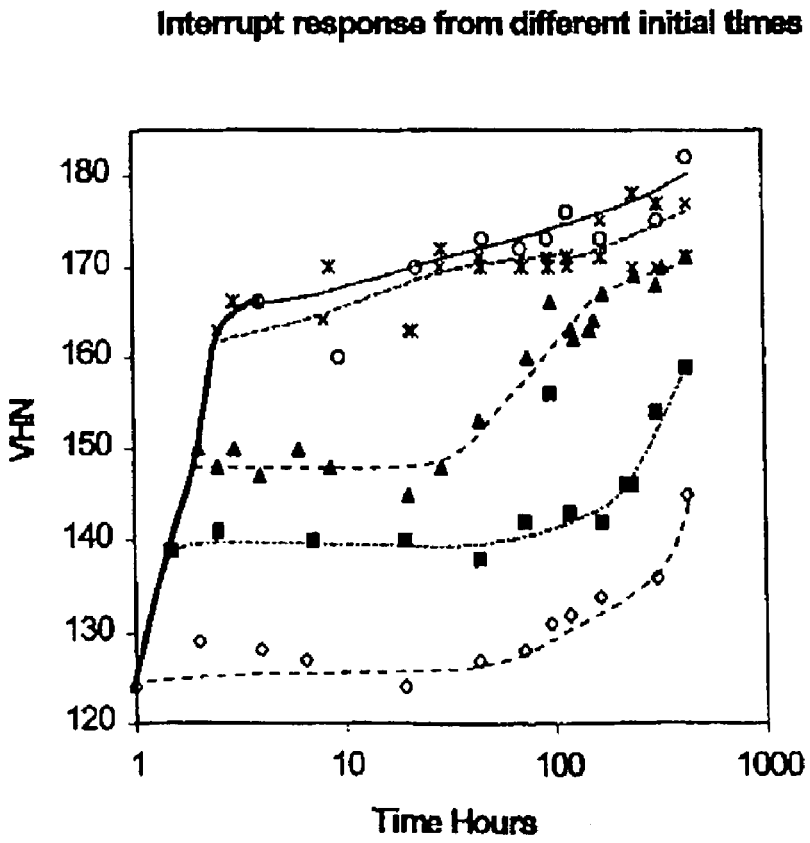
Figure 8:
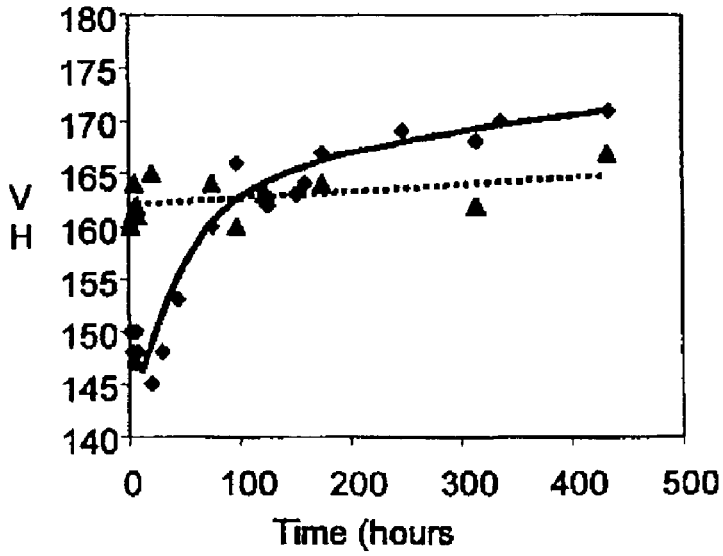
Figure 9:
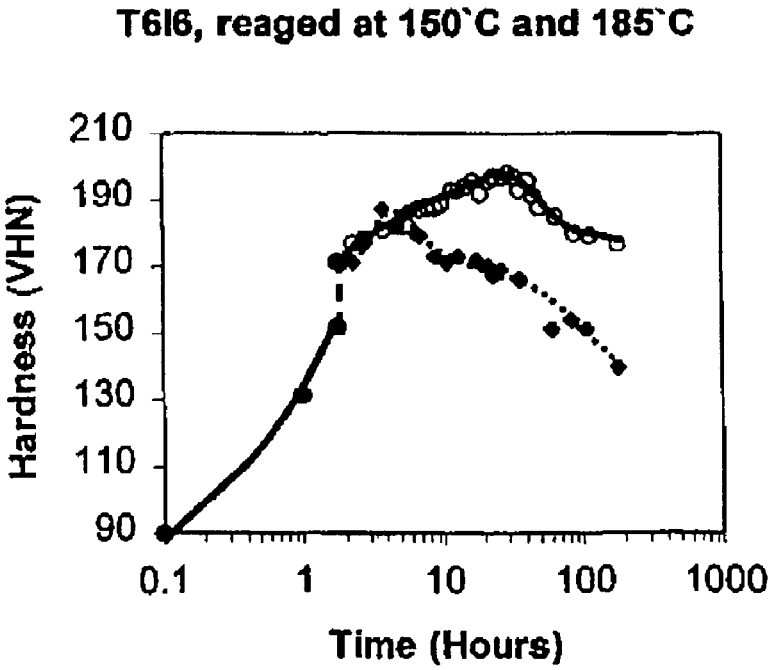
Figure 10:
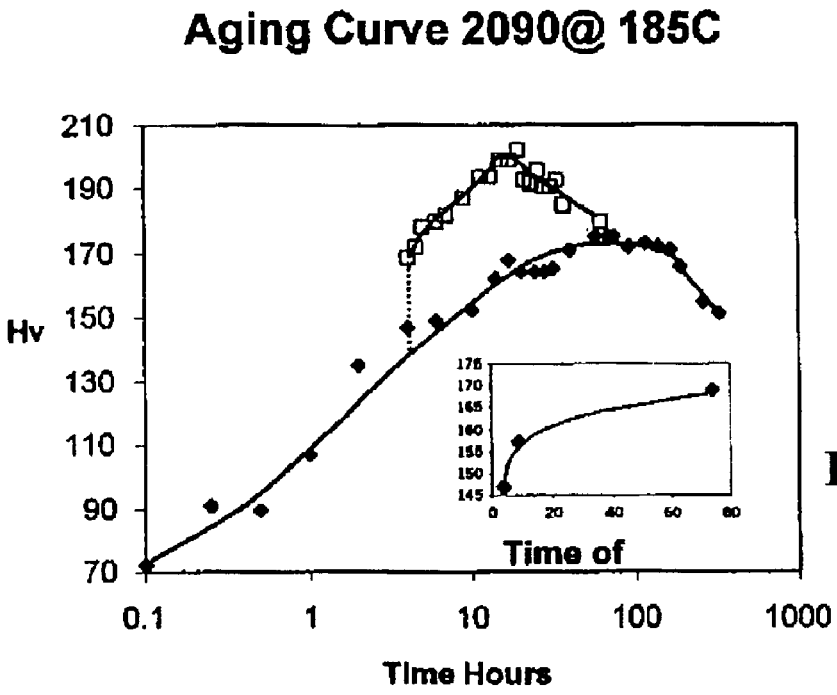
Figure 11:
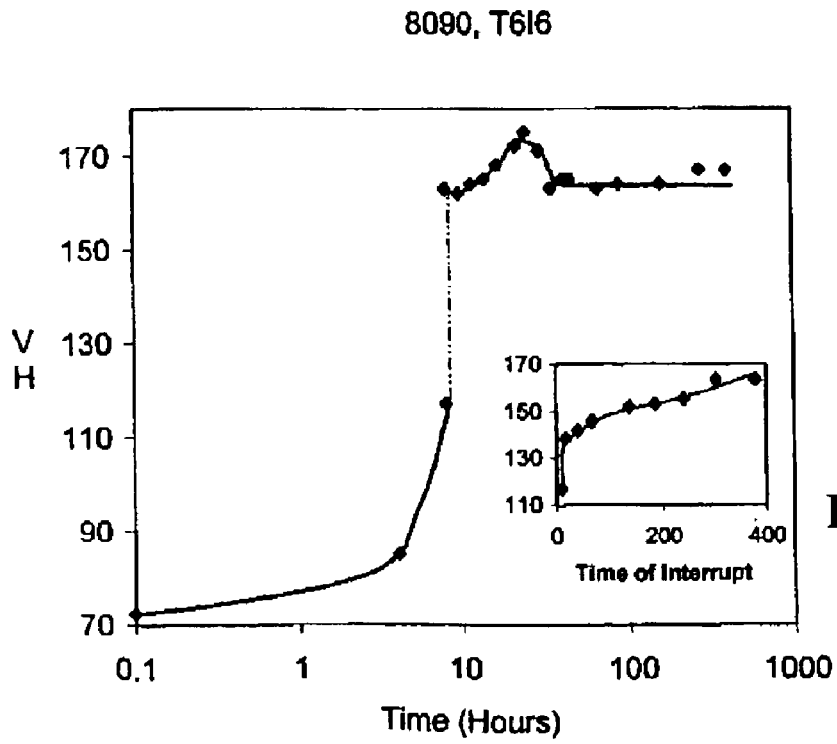
Figure 12:
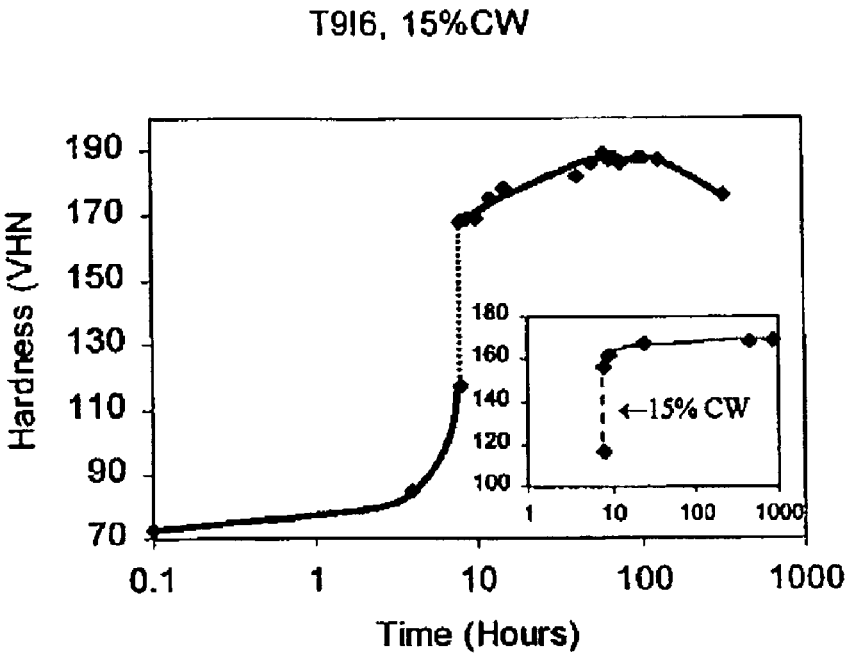
Figure 13:
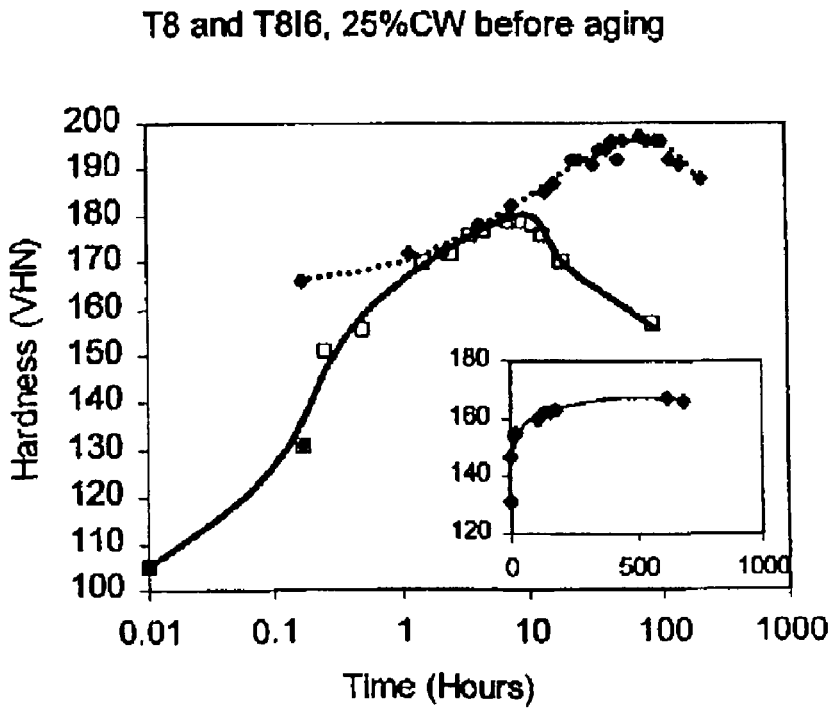
Figure 18:
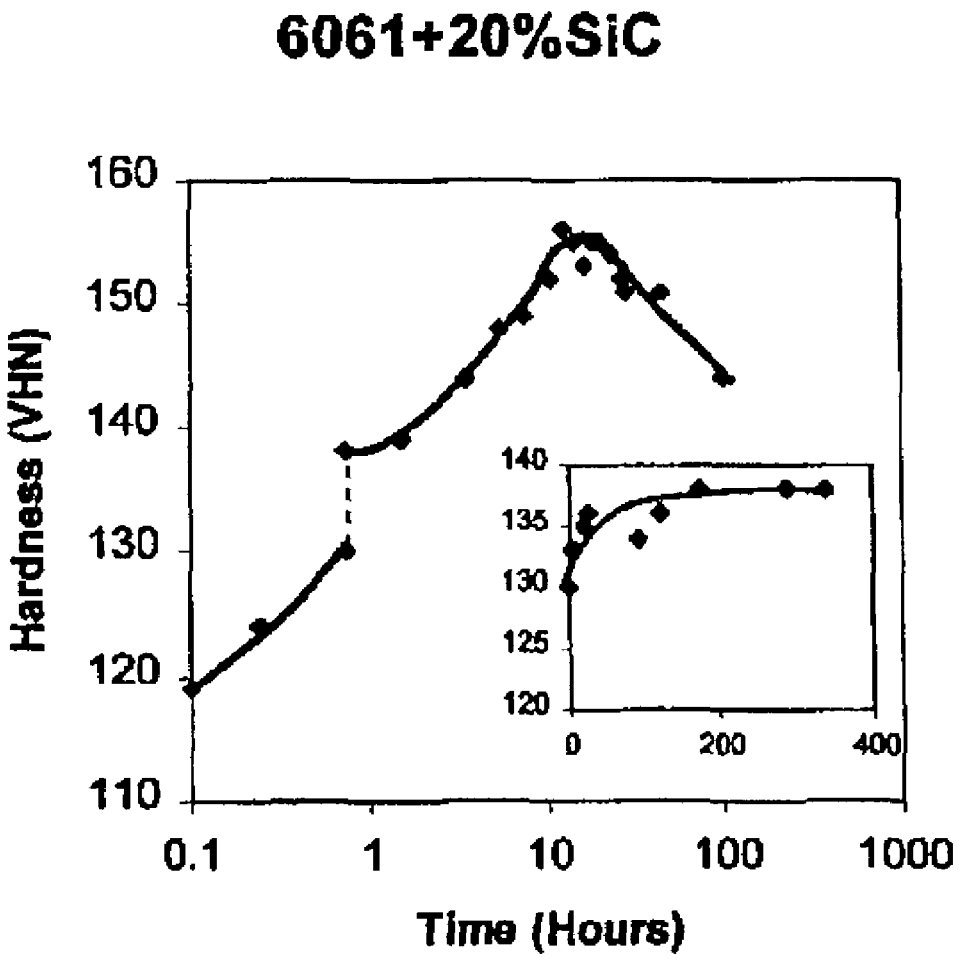
Figure 19:
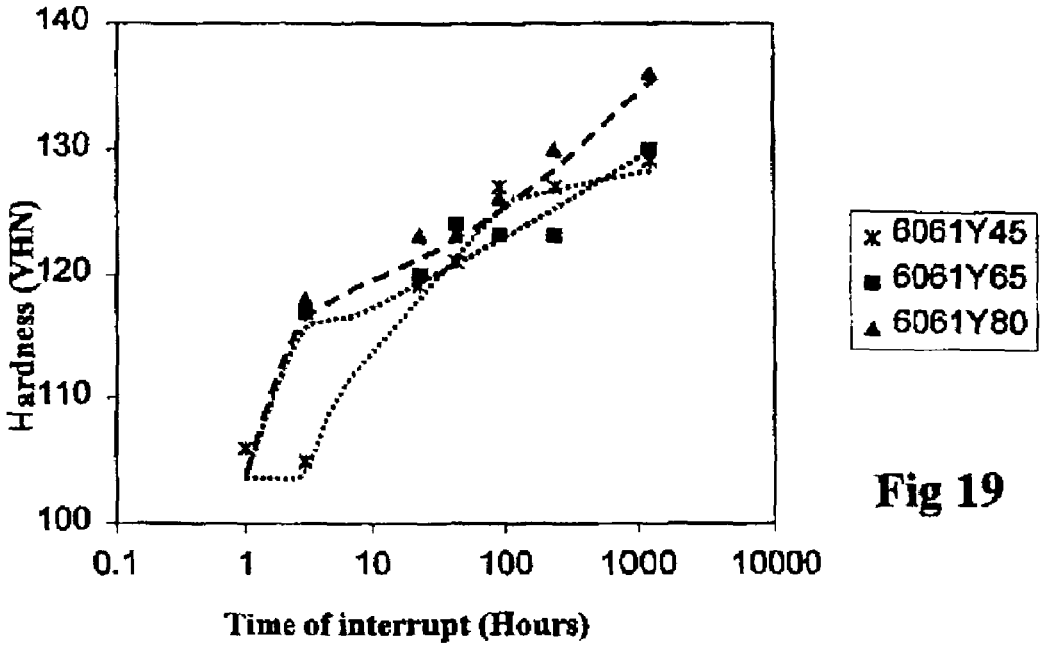
Figure 20:
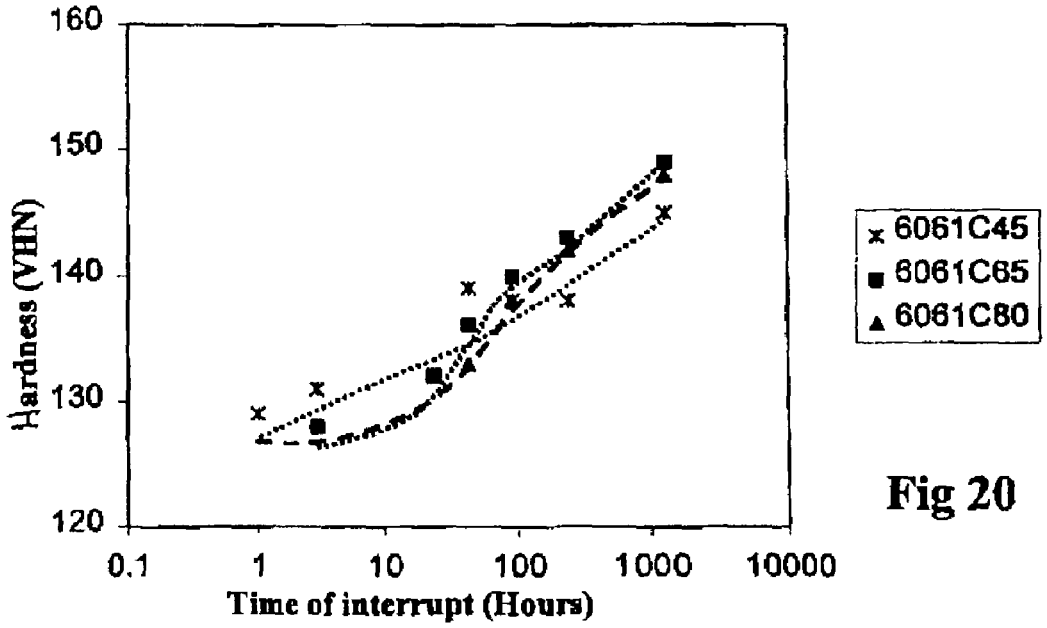
Figure 21:
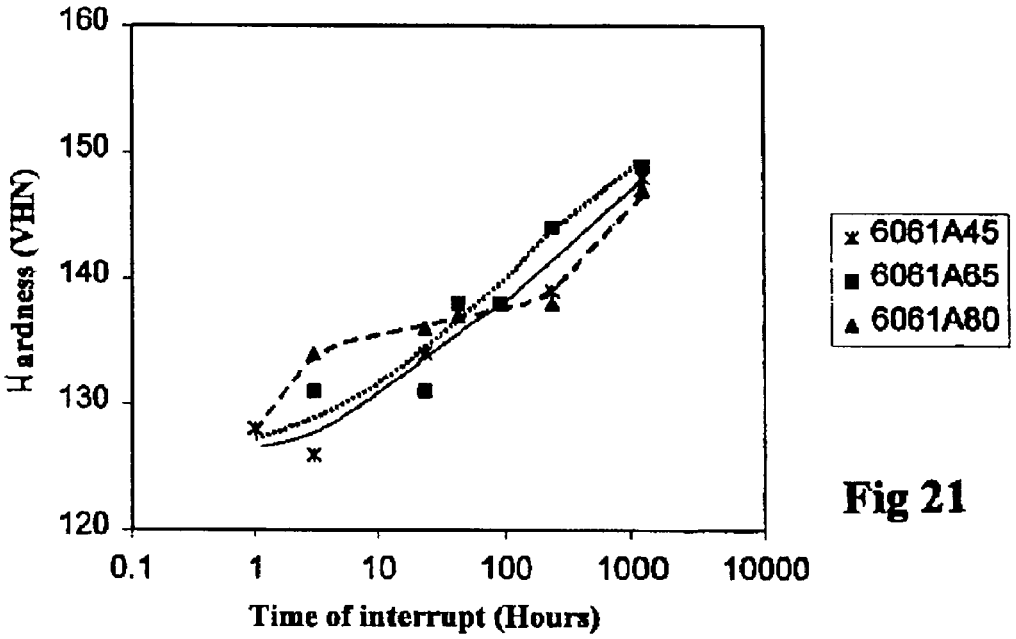
Figure 22:
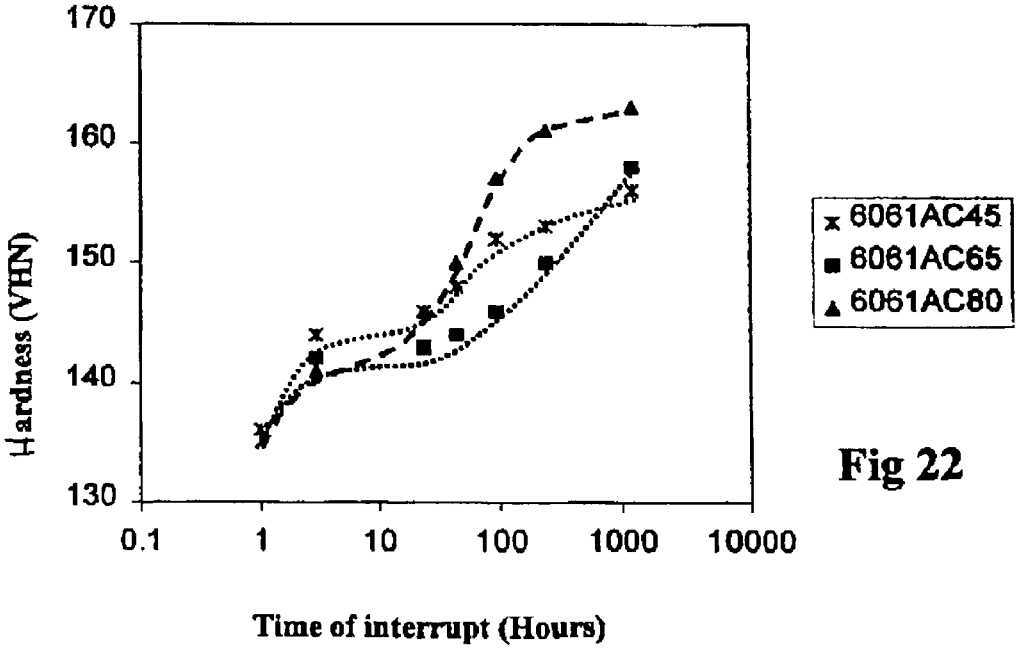
Figure 23:
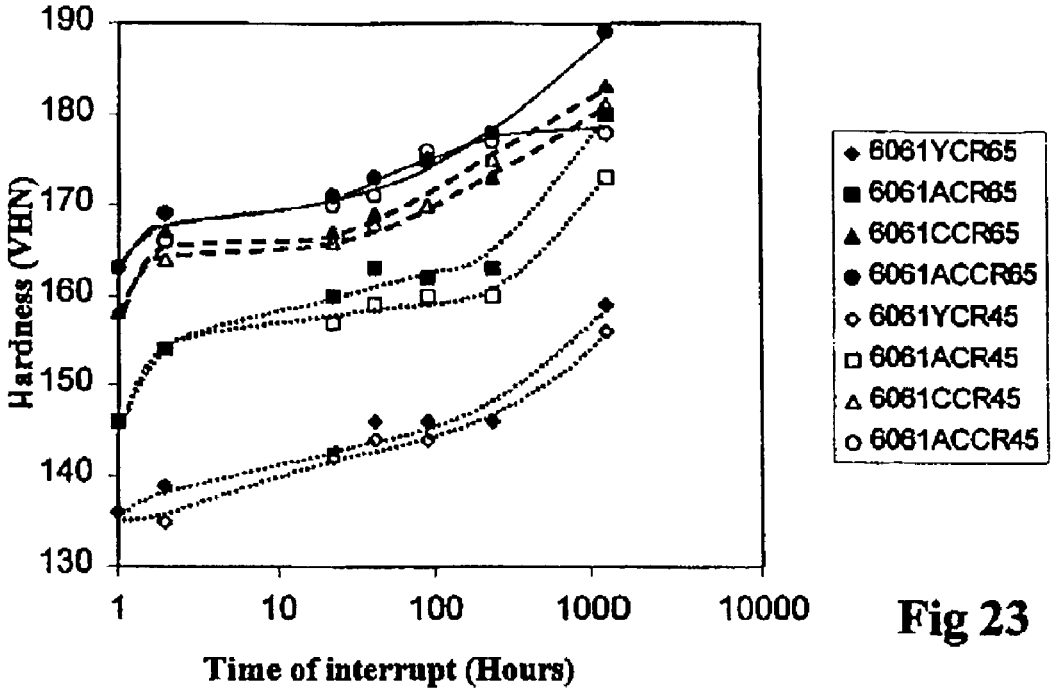
Figure 24:
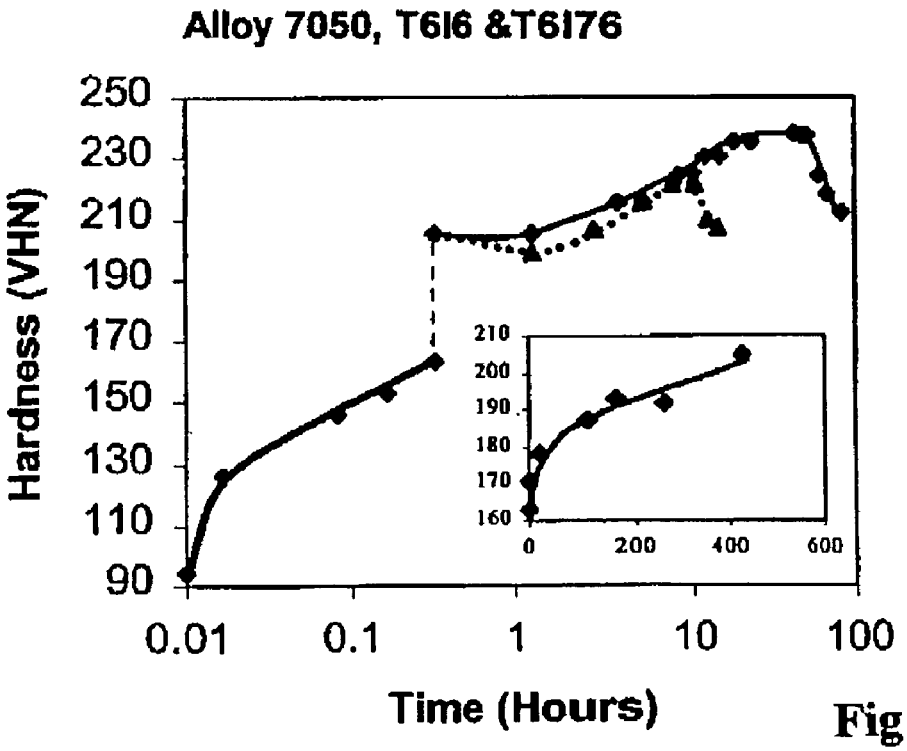
Figure 25:
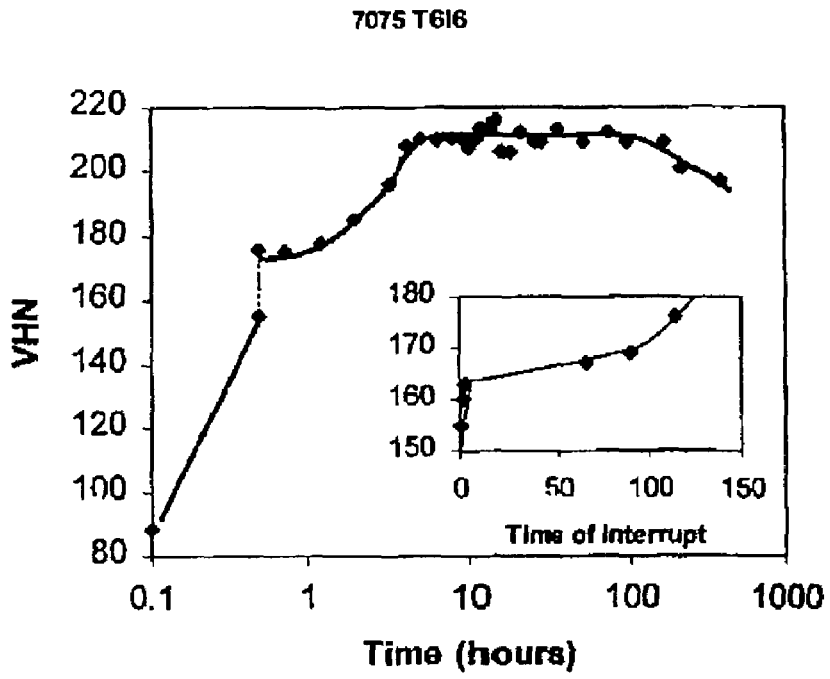
Figure 26:
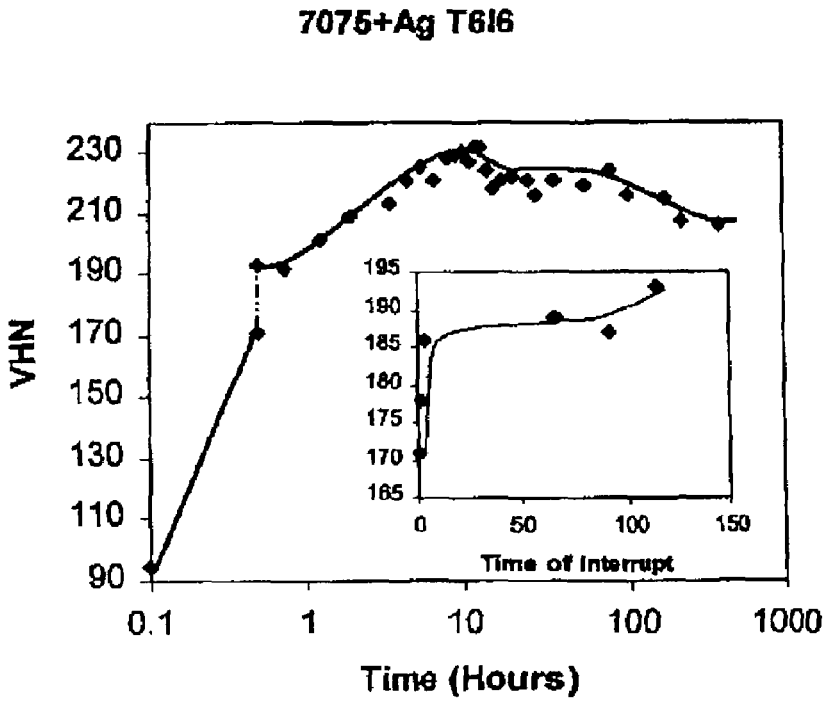
Figure 27A:
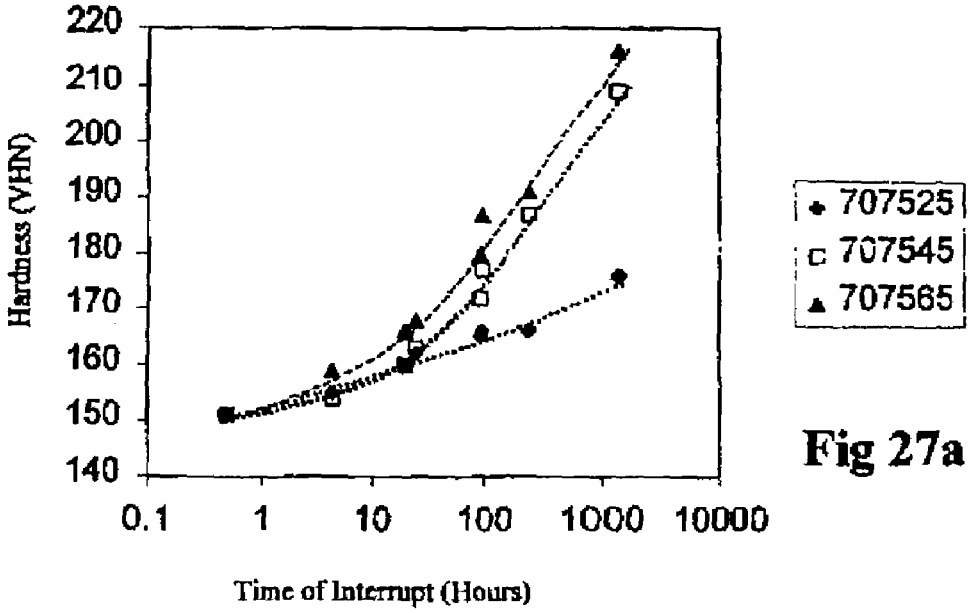
Figure 27B:
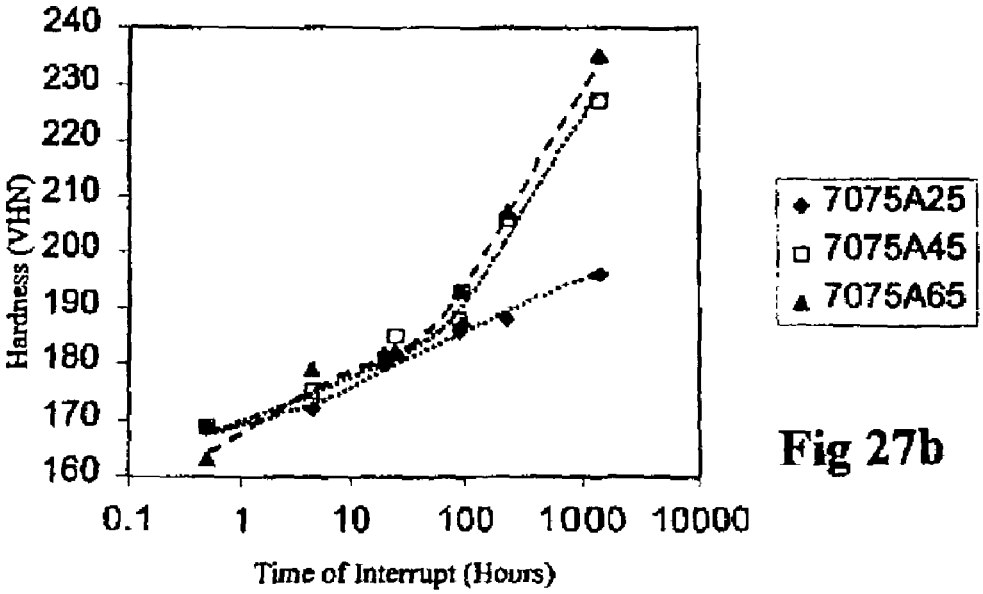
Figure 28:
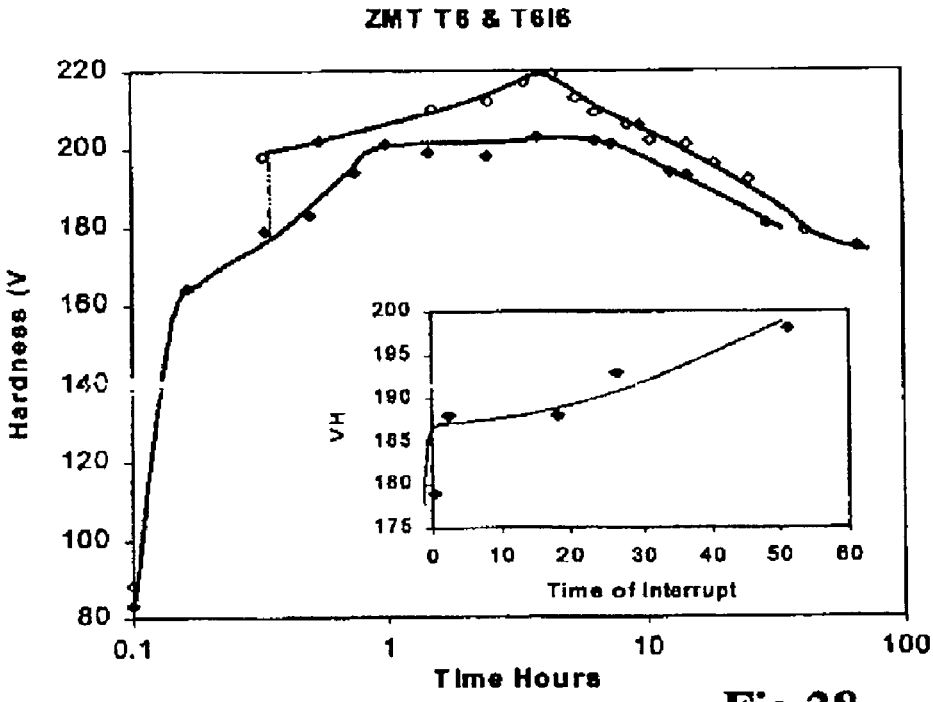
Figure 29:
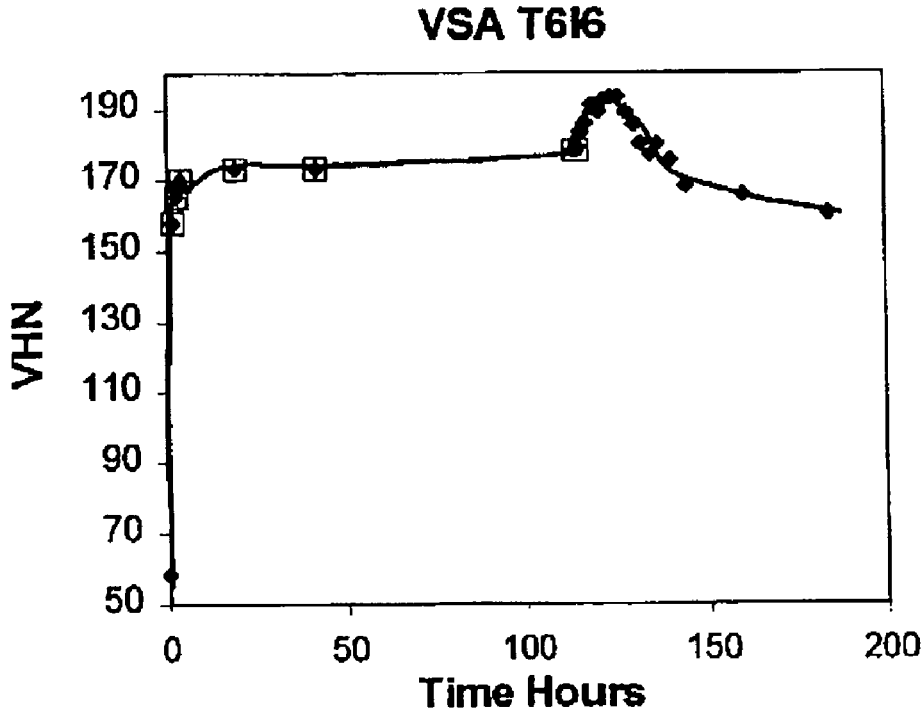
Figure 30:
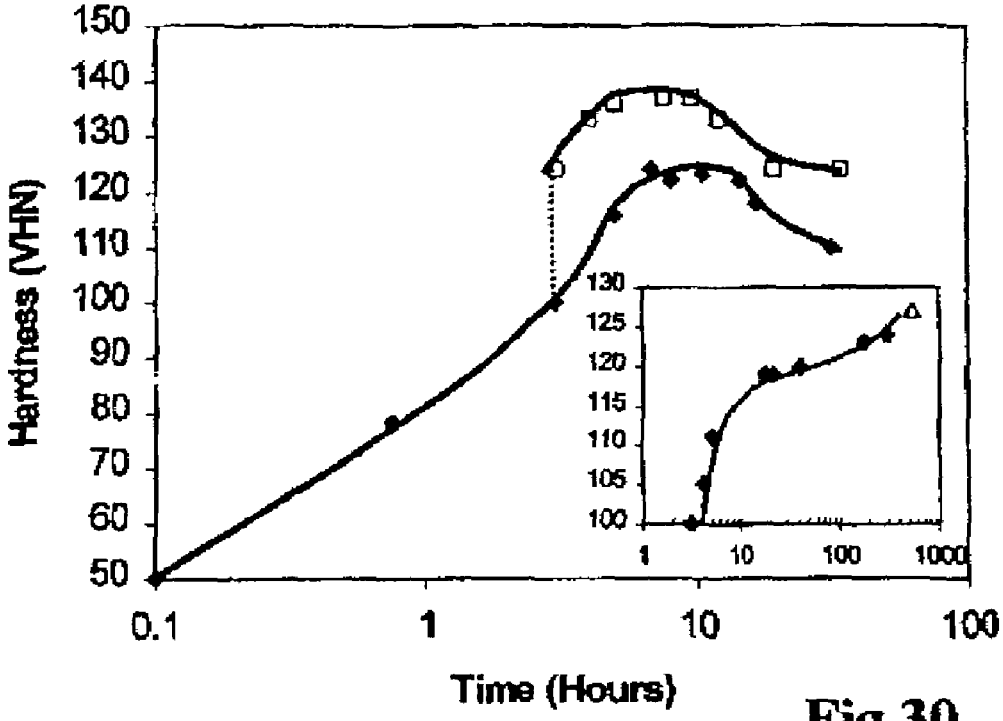
Figure 31:
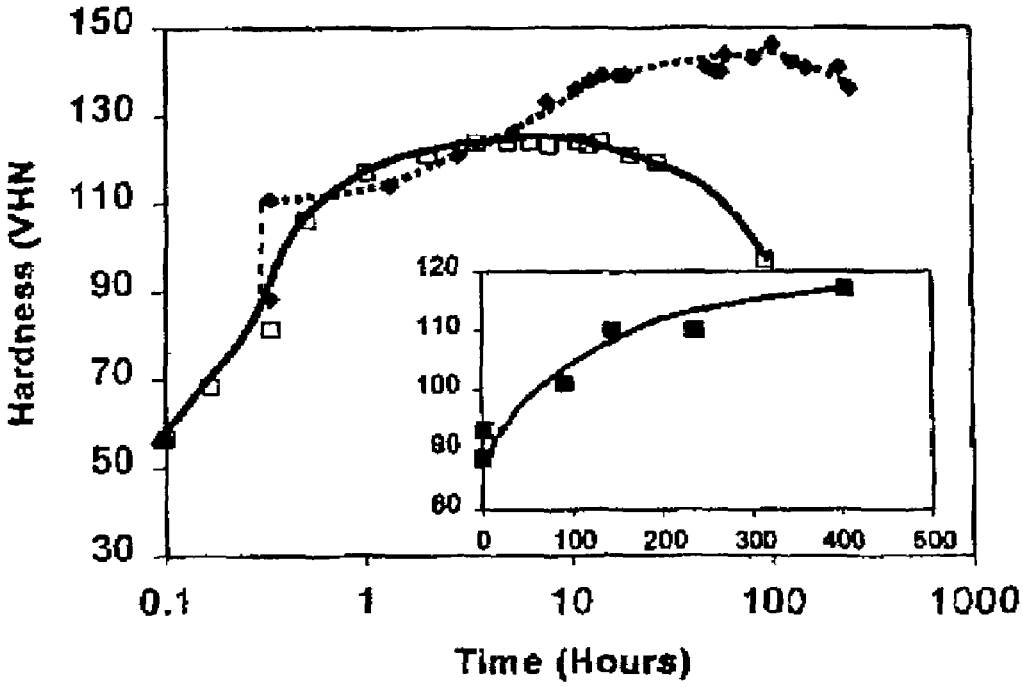
Figure 32:
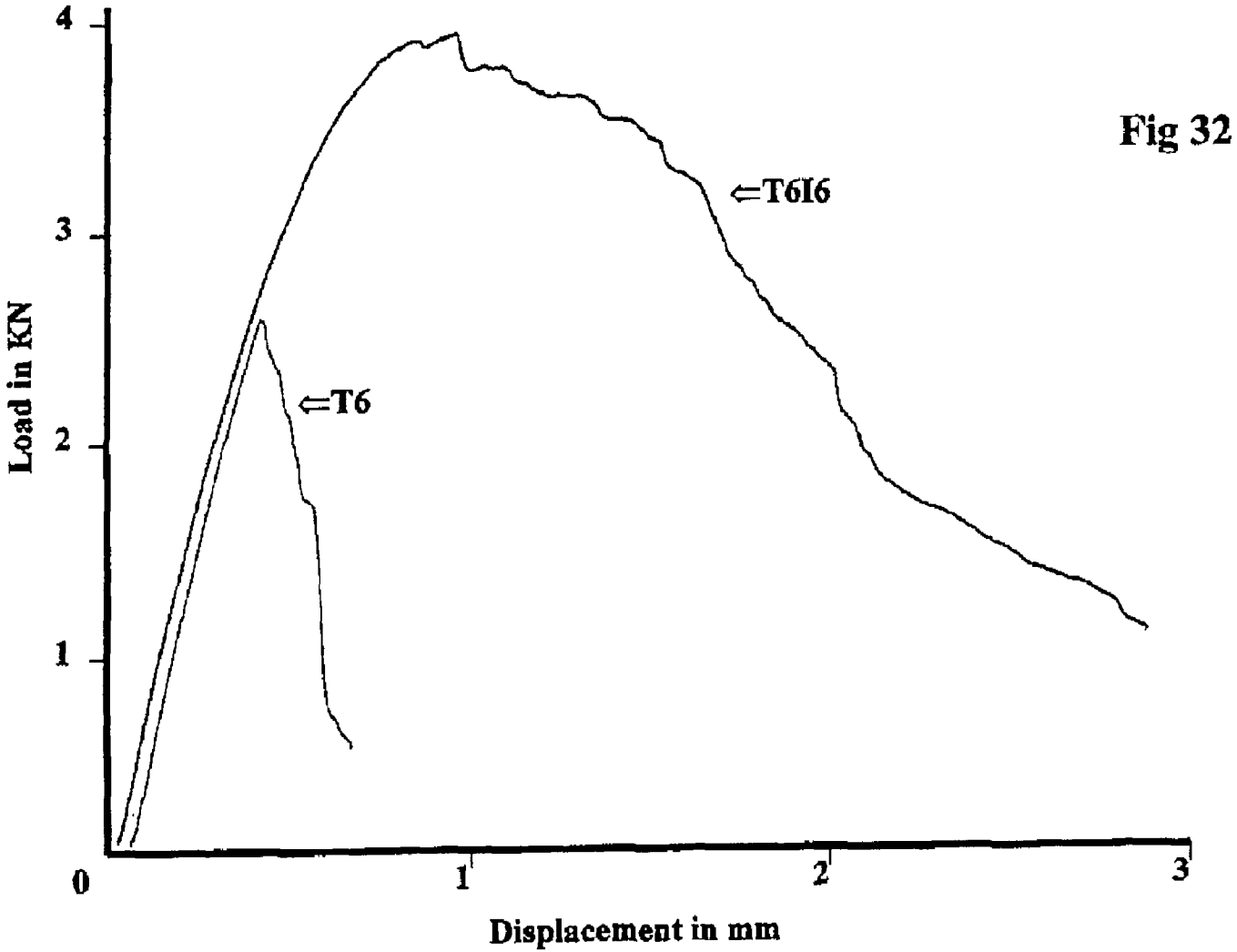
Figure 33:
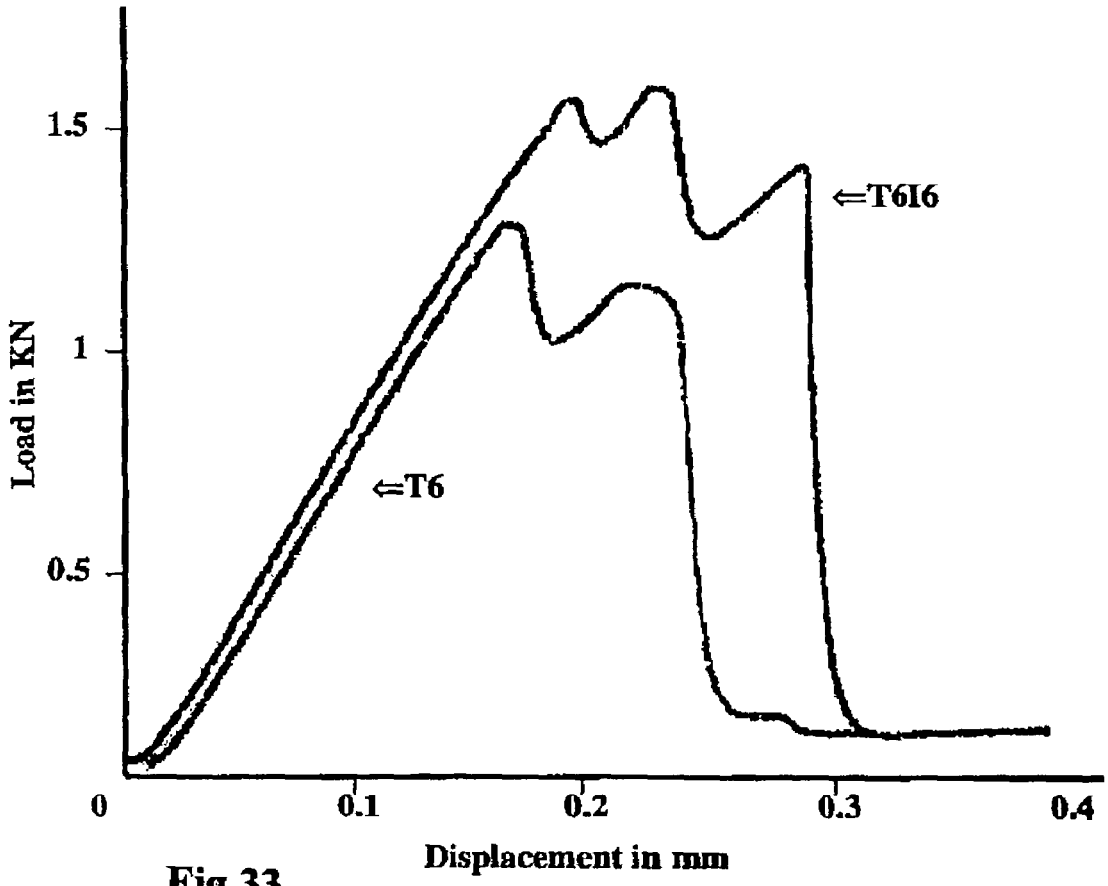
Figure 34:
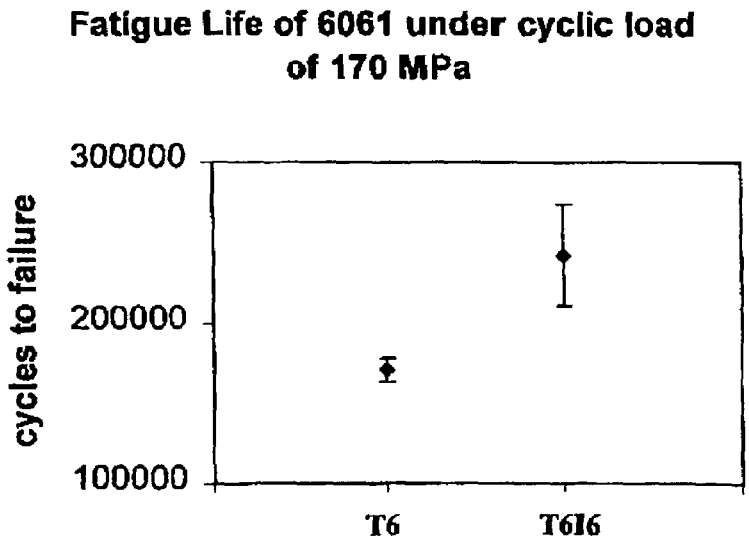

FIG. 5 corresponds to FIG. 2, but is in respect of alloy 2014;

FIG. 6 corresponds to FIG. 2, but is in respect of Al—Cu—Mg—Ag alloy for both a T6 temper and, according to the present invention, a T6I6 temper;

FIG. 7 illustrates stage (c) of the invention for the Al—Cu—Mg—Ag alloy of FIG. 6;

FIG. 8 shows the effect of cooling rate from $T_A$ for the Al—Cu—Mg—Ag alloy T6I6 temper according to the invention;

FIG. 9 illustrates for the Al—Cu—Mg—Ag alloy regression able to occur in the T6I6 temper;

FIG. 10 corresponds to FIG. 2, but is in respect of 2090 alloy;

FIG. 11 shows a T6I6 hardness curve for 8090 alloy;

FIG. 12 shows a hardness curve for the 8090 alloy with a T9I6 temper including a cold working stage;

FIG. 13 shows T8 and T8I6 hardness curves for the 8090 alloy cold worked after solution treatment;

FIG. 14 to 17 illustrate T6 and T6I6 hardness curves for respective 6061, 6013, 6061+Ag and 6013+Ag alloys;

FIG. 18 shows a T6I6 hardness curve for alloy material comprising 6061+20% SIC;

FIGS. 19 to 22 show plots for the respective alloys of FIG. 14 to 17 as a function of interrupt hold temperature in T6I6 tempers according to the invention;

FIG. 23 shows the effect of a cold working step between stages (b) and (c) in the T6I6 temper for the respective alloys of FIGS. 19 to 22;

FIG. 24 shows hardness curves for T6I6 and T6I76 tempers according to the invention for 7050 alloy;

FIGS. 25 and 26 show hardness curves for T6I6 tempers for respective 7075 and 7075+Ag alloys;

FIG. 27 shows the effect of temperature on the interrupt of stage (c) for the process and respective alloys of FIGS. 25 and 26;

FIG. 28 shows a comparison of T6 and T6I6 ageing curves for an Al—Zn-3 Mg alloy;

FIG. 29 shows a T6I6 hardness curve for Al-6Zn-2Mg-0.5Ag alloy on a linear time scale;

FIGS. 30 and 31 show ageing curves for T6 and T6I6 tempers for 356 and 357 casting alloys respectively;

FIGS. 32 and 33 show plots illustrating fracture toughness/damage tolerance behaviour for 6061 and 8090 alloys after each of T6 and T6I6 tempers; and FIG. 34 compares cycles to failure in fatigue tests on 6061 alloy after T6 and T6I6 tempers The present invention enables the establishment of conditions whereby aluminium alloys which are capable of age hardening may undergo this additional hardening at a lower temperature $T_B$ if they are first underaged at a higher temperature $T_A$ for a short time and then cooled such as by being quenched to room temperature. This general effect is demonstrated in FIG. 1, which is a schematic representation of how the interrupted ageing process of the invention is applied to age hardenable alloys in a basic form of the present invention. As shown in FIG. 1, the ageing process utilises successive stages (a) to (d). However, as shown, stage (a) is preceded by a preliminary solution treatment in which the alloy is held at a relatively high initial temperature and for a time sufficient to facilitate solution of alloy elements. The preliminary treatment may have been conducted in the alloy as received, in which case the alloy typically will have been quenched to ambient temperature, as shown, or below ambient temperature. However, in an alternative, the preliminary treatment may be an adjunct to the process of the invention, with quenching being to the temperature $T_A$ for stage (a) of the process of the invention, thereby obviating the need to reheat the alloy to $T_A$.

In stage (a), the alloy is aged at temperature $T_A$. The temperature $T_A$ and the duration of stage (a) are sufficient to achieve a required level of underaged strengthening, as described above. From $T_A$, the alloy is quenched in stage (b) to arrest the primary precipitation ageing in stage (a); with the stage (b) quenching being to or below ambient temperature. Following the quenching stage (b), the alloy is heated to temperature $T_B$ in stage (c), with the temperature at $T_B$ and the duration of stage (c) sufficient to achieve secondary nucleation, or continuing precipitation of solute elements After stage (c), the alloy is further heated in stage (d) to temperature $T_C$, with the temperature $T_C$ and the duration of step (d) sufficient to achieve ageing of the alloy to achieve the desired properties. The temperatures and durations may be as described early herein.

In relation to the schematic representation shown in FIG. 1 of the interrupted ageing process and how it is applied to all age hardenable aluminium alloys, the time at temperature $T_A$ is commonly from between a few minutes to several hours, depending on the alloy. The time at temperature $T_B$ is commonly from between a few hours to several weeks, depending on the alloy. The time at temperature $T_C$ is usually several hours, depending on both the alloy and the re-ageing temperature $T_C$, where is here represented by the shaded region in the diagram.

FIG. 2 shows application of the process of the present invention to Al-4Cu alloy. In FIG. 2, the solid line shows the hardness-time (ageing) curve obtained when the Al-4Cu alloy is first solution treated at 540° C., quenched into cold water and aged at 150° C. A peak T6 value of hardness of 132 VHN is achieved after 100 hours. The dashed curves show respective hardening responses if a low temperature interrupt stage is introduced, i.e. the process of the invention is introduced, for the treatment (designated as a T6I6 treatment). In this case, the alloy has been:

(a) aged for only 2.5 hours at 150° C.;
(b) quenched into quenchant;
(c) held at 65° C. for 500 hours;
(d) re-aged at 150° C.

The peak hardness is now achieved in the shorter time of 40 hours and has been increased to 144 VHN.

As indicated, the solid line in FIG. 2 (filled diamonds) is the ageing response for Al-4Cu alloy conventionally aged at 150° C. in accordance with the T6 heat treatment. The dashed lines in the main diagram shows the ageing response for a $T_C$ temperature after an interrupt quench and $T_B$ interrupt hold at 65° C. The $T_C$ reageing was at each of 130° C. (triangles) and 150° C. (squares). The inset diagram shows the ageing response plot for the interrupt hold at 65° C., with this being represented by the vertical dashed line in the main diagram.

Figure 3:
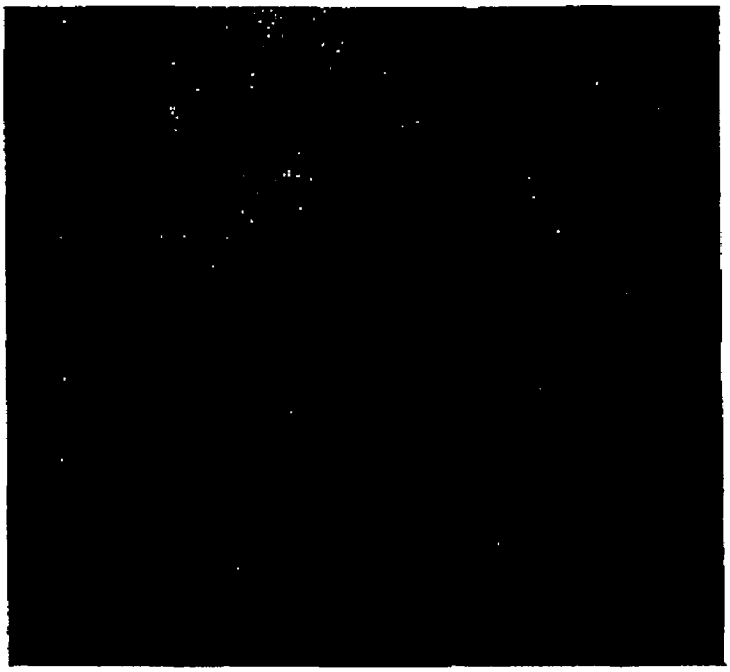
FIG. 3 shows respective photomicrographs for T6 and T6I6 processing of FIG. 2 for Al-4 Cu alloy.
Figure 3:
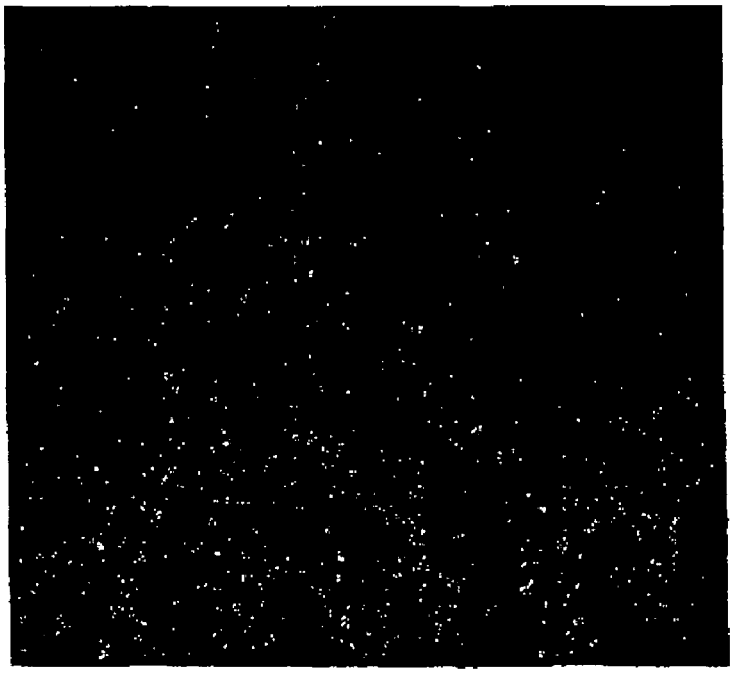

FIG. 3 shows examples of micrographs developed in the T6 and T6I6 tempering of Al-4Cu alloy as described with reference to FIG. 2. The variation in microstructures of the T6 and T6I6 processing shown in FIG. 3 is considered representative of the difference in structure developed in all age hardenable aluminium alloys processed in a similar fashion. As seen in FIG. 3, the T6I6 process results in the development of microstructures having a higher precipitate density and a finer precipitate size than the peak aged material resulting from the T6 processing.

Figure 4:
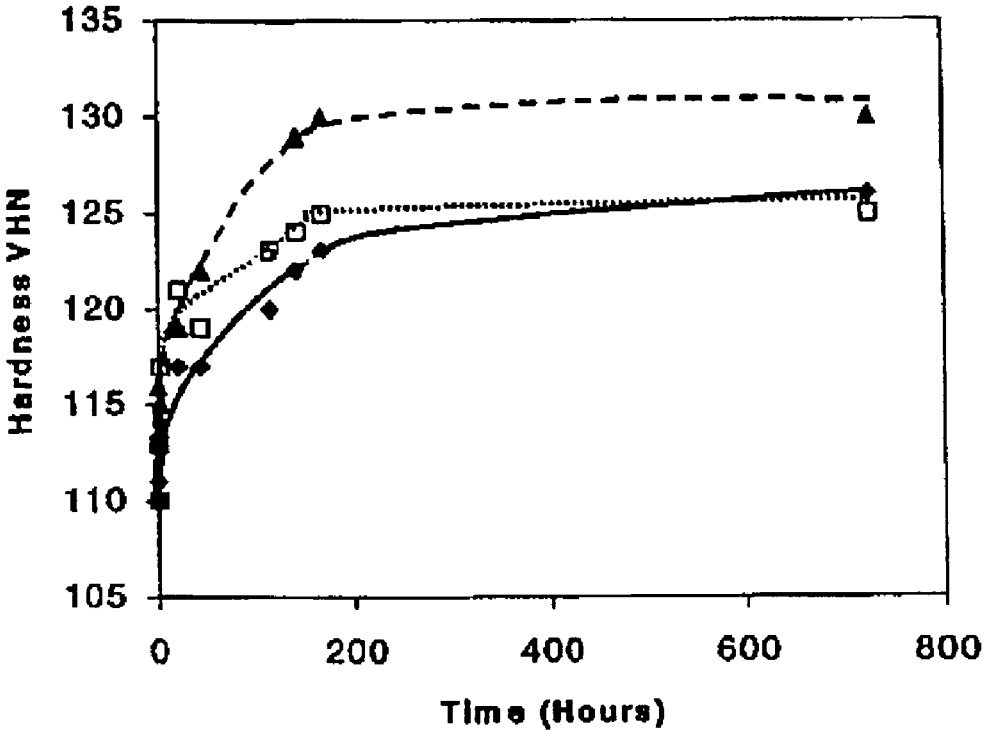
FIG. 4 shows a plot of time against hardness, showing the effect of cooling rate from $T_A$ in the process of the invention for Al-4 Cu alloy.

FIG. 4 shows for the Al-4Cu alloy, treated as described with reference to FIG. 2, the effect of cooling rates from the first ageing temperature $T_A$, on the ageing response developed in the low temperature ($T_B$) ageing period. Here it is seen that some benefit may be gained by the use of cold water or other cooling media appropriate to the particular alloy. More specifically, FIG. 4 shows the effect of cooling rate from the ageing temperature of 150° C. ($T_A$) on the low temperature interrupt response for Al-4Cu. Filled diamonds are for a quench into water at ~−65° C., open squares are for a quench into cold water at ~−15° C. and filled triangles for a quench into a quenchant mixture of ethylene glycol, ethanol, NaCl and water at ~−10° C. The effect shown by FIG. 4 varies from alloy to alloy.

Examples of the increases in hardness, in response to age hardening by applying the T6I6 treatment in accordance with the invention are shown in Table 1 for a range of alloys, as well as selected examples of variants of the standard treatments. Typical tensile properties developed in response to T6I6 age hardening according to the invention are shown in Table 2. In each of Tables 1 and 2, the corresponding T6 values for each alloy are presented. In most cases, it will be seen from Table 2 that the ductility as measured by the percent elongation after failure is either little changed or increased, although this is alloy dependent. It also is to be noted that there is no detrimental effect to either fracture toughness or fatigue strength with the T6I6 treatment.

TABLE 1

COMPARISON OF MAXIMUM HARDNESS VALUES OBTAINED USING T6 AND T6I6 AGING TREATMENTS AND SELECTED VARIANTS

| Alloy (Aluminum Association Designation or composition) | T6 Peak Vickers Hardness values 10 kg load | T6I6 Peak Vickers Hardness values 10 kg load |
|---|---|---|
| Al—4Cu | 132 | 144 |
| 2014 | 160 | 180 |
| 2090 | 173 | 200 |
| Al—5.6Cu—0.45Mg—0.45Ag—0.3Mn—0.18Zr | 177 | 198 |
| 6061 | 125 | 144 |
| 6013 | 145 | 163 |
| 6061 + 20% SiC | (fully hardened, as received) 129 | 156 |
| 7050 | 213 | 238 |
| 7050 | (T76) 203 | (T6I76) 226 |
| 7075 | 189 | 210 |
| 8090 | 160 | 175 |
| 8090 | (T8) 179 | (T8I6) 196 |
| 356, sand cast, no chills or modifiers | 124 | 137 |
| 357, Chill cast permanent mold, Sr modifier | 126 | 140 |

TABLE 2

COMPARISON OF STRENGTH VALUES OBTAINED USING T6 AND T6I6 AGEING TREATMENTS

| | Typical T6 tensile properties | | | Typical T6I6 tensile properties | | |
|---|---|---|---|---|---|---|
| Alloy | 0.2% proof stress MPa | UTS MPa | % strain to failure | 0.2% proof stress MPa | UTS MPa | % strain to failure |
| Al—4Cu | 236 | 325 | 5% | 256 | 358 | 7% |
| 2011 | 239 | 377 | 18% | 273 | 403 | 13% |
| 2014 | 414 | 488 | 10% | 436 | 526 | 10% |

TABLE 2-continued

COMPARISON OF STRENGTH VALUES OBTAINED USING T6 AND T6I6 AGEING TREATMENTS

| | Typical T6 tensile properties | | | Typical T6I6 tensile properties | | |
|---|---|---|---|---|---|---|
| Alloy | 0.2% proof stress MPa | UTS MPa | % strain to failure | 0.2% proof stress MPa | UTS MPa | % strain to failure |
| 2090 | ‡(T6) 346<br>**(T81) 517 | (T6) 403<br>**(T81) 550 | (T6) 4%<br>**(T81) 8% | 414 | 523 | 4% |
| Al—5.6Cu—0.45Mg—0.45Ag—0.3Mn—0.18Zr | 442 | 481 | 12% | 502 | 518 | 7% |
| 8090 | **373 | **472 | 6% | 391 | 512 | 5% |
| 2024 | ##(T8) 448 | (T8) 483 | (T8) 7% | (T9I6)<br>585 | (T9I6)<br>659 | 10% |
| 6061 | 267 | 318 | 13% | 299 | 340 | 13% |
| 6061 + Ag | 307 | 349 | 12% | 324 | 373 | 15% |
| 6013 | 295##(330) | 371 | 14% | 431<br>(typical in bulk 370)xx | 510<br>(typical in bulk 423)xx | 13%<br>(typical in bulk 18% |
| 7050 | 546 | 621 | 14% | 574 | 639 | 13% |
| 7050 T76 | 558 | 611 | 13% | 575 | 621 | 12% |
| 7075 | 505 | 570 | 10% | 535 | 633 | 13% |
| 7075 + Ag | 504 | 586 | 11% | 549 | 641 | 13% |
| Casting alloy 356 | 191 | 206 | 1% | 232 | 260 | 2% |
| Casting alloy 357 | 287 | 340 | 7% | 327 | 362 | 3% |

‡T6 value for 2090 may be abnormally low; typical T8I values are therefore included.
**values taken from "Smithells Reference Book", 7th edition by E. A. Brandes and G. B. Book, 1998.
values taken from "ASM Metals Handbook", 9th ed., Vol. 2, Properties & Selection: Nonferrous Alloys and Pure Metals, ASM, 1979
xxvarious values, depends on specimen geometry and specific processing.
Note: All data listed above gained from the average of three separate tensile tests, except where otherwise detailed.

The strain to failure in the comparison of Table 2 for casting alloy 357 appears to be inconsistent with other data presented. However it should be noted that the test batch from which these samples were taken typically display levels between 1 and 8% strain, with a mean of ~4.5%. Therefore it should be considered that the values presented for the T6 and T6I6 tempers in alloy 357 are effectively equivalent.

Table 3 shows typical hardness values associated with T6 peak ageing, and the maximum hardness developed during stage (d) for the T6I6 condition for the various alloys. Table 3 also shows the time of the first ageing temperature during stage (a) and the typical hardness at the end of stage (a). Additionally, Table 3 shows for each alloy the approximate increase in hardness during the entire $T_B$ hold of stage (c), as well as the increase in hardness during the $T_B$ hold, after 24 and 48 hours and at different $T_B$ temperatures.

TABLE 3

T6 & T6I6 PEAK HARDNESS VALUES RELATED TO $T_B$ INTERRUPT HOLD (STAGE (C)) INCREASES

| | Time of first ageing | Typical Hardness at the | Typical T6 Peak | Typical T6I6 peak | Typical maximum increase | Maximum increase in 24, 48 hours interrupt (stage (c)) | | |
|---|---|---|---|---|---|---|---|---|
| Alloy | temperature, Ta during stage (a) | end of stage (a) VHN | Hardness VHN | hardness VHN | during (stage (c)) VHN | Temp ° C. ($T_B$) | 24 hours VHN | 48 hours VHN |
| Al—4Cu | 2.5 hours at 150° C. | 104 | ~132 | ~144 | ~20 | 65° C. | 4 | 7 |
| 2014 | 0.5 hours at 177° C. | 131 | ~165 | ~188 | ~18 | 65° C. | 3 | 5 |
| Al—5.6Cu—0.45Mg—0.45Ag—0.3Mn—0.18Zr | 2 hours at 185° C. | 150 | 175 | 190–202 | ~20 | 25° C. | 0 | 3 |
| | | | | | | 35° C. | 14 | 22 |
| | | | | | | 65° C. | 22 | 22 |
| 2090 | 4 hours at 185° C. | 133 | ~175 | ~190–200 | ~25 | 25° C. | 0 | 0 |
| | | | | | | 35° C. | 0 | 0 |
| | | | | | | 65° C. | 7 | 12 |
| 8090 | 8 hours at 185° C. | 117 | ~160 | ≧175 | ~46 | 35° C. | 18 | 21 |
| | | | | | | 65° C. | 23 | 26 |
| 2024 T9I6 | 4 hours at 185° C. | 191 after cold work | | 221 | ~18 | 65° C. | 12 | 8<br>18 |
| 7075 | 0.5 Hours at 130° C. | 155 | 202 | 210 | ~≧20 | 25° C. | 11 | 13 |
| | | | | | | 35° C. | 10 | 11 |
| | | | | | | 45° C. | 12 | 18 |
| | | | | | | 65° C. | 17 | 21 |

TABLE 3-continued

T6 & T6I6 PEAK HARDNESS VALUES RELATED TO $T_B$ INTERRUPT HOLD (STAGE (C)) INCREASES

| Alloy | Time of first ageing temperature, Ta during stage (a) | Typical Hardness at the end of stage (a) VHN | Typical T6 Peak Hardness VHN | Typical T6I6 peak hardness VHN | Typical maximum increase during (stage (c)) VHN | Maximum increase in 24, 48 hours interrupt (stage (c)) Temp ° C. ($T_B$) | 24 hours VHN | 48 hours VHN |
|---|---|---|---|---|---|---|---|---|
| 7075 + Ag | 0.5 hours at 130° C. | 171 | 212 | 232 | ~≧20 | 25° C. | 13 | 17 |
| | | | | | | 35° C. | 16 | 17 |
| | | | | | | 45° C. | 16 | 18 |
| | | | | | | 65° C. | 19 | 24 |
| Al—8Zn—3Mg | 0.333 hours at 150° C. | 179 | 203 | 220 | ~21 | 35° C. | 13 | 20 |
| VSA | 0.75 hours at 150° C. | 158 | ~170 | 193 | ~20 | 35° C. | 15 | 17 |
| 6061 | 1 hour at 177° C. | 106 | 124 | 138 | ~17 | 35° C. | 6 | 8 |
| | | | | | | 45° C. | 13 | 15 |
| | | | | | | 65° C. | 14 | 19 |
| | | | | | | 80° C. | 17 | 17 |
| 6061 + Ag | 1 hour at 177° C. | 128 | 136 | 151 | ~22 | 35° C. | 20 | 21 |
| | | | | | | 45° C. | 6 | 11 |
| | | | | | | 65° C. | 5 | 10 |
| | | | | | | 80° C. | 8 | 9 |
| 6013 | 1 hour at 177° C. | 129 | 145 | 156 | ~22 | 35° C. | 5 | 7 |
| | | | | | | 45° C. | 7 | 11 |
| | | | | | | 65° C. | 3 | 8 |
| | | | | | | 80° C. | 3 | 5 |
| 6013 + Ag | 1 hour at 177° C. | 136 | 152 | 166 | ~20 | 35° C. | 12 | 14 |
| | | | | | | 45° C. | 10 | 13 |
| | | | | | | 65° C. | 7 | 8 |
| | | | | | | 80° C. | 11 | 15 |
| Casting alloy 357 | 0.333 hours at 177° C. | 93 | 124 | 140 | 30 | 65° C. | 14 | 18 |
| Casting alloy 356 | 3 hours at 177° C. | 100 | 123 | 137 | ~25 | 65° C. | 20 | 20 |

FIG. 5 corresponds to FIG. 2, but relates to 2014 alloy, again with an interrupt hold at 65° C. The alloy 2014 was aged according to the T6I6 temper, after benign solution treated at 505° C. for 1 hour. The inset plot shows an interrupt hold at 65° C., represented by vertical dashed line in main diagram.

FIG. 6 illustrates respective hardness curves for Al—Cu—Mg—Ag alloy for a conventional T6 temper (triangles) and a T6I6 temper according to the invention (squares). The alloy, specifically Al-5.6Cu-0.45Mg-0.45Ag-0.3Mn-0.18Zr was solution treated at 525° C. for 8 hours. The T6 curve (triangles) applies to the alloy aged at 185° C., while the T6I6 curve (open squares) applies to the alloy aged initially at 185° C., held for interrupt at 25° C., and re-aged at 185° C.

FIG. 7 shows for that alloy hardening during respective interrupt holds (stage (c)) each at 25° C., but with respective levels of underageing as represented by the solid curve. FIG. 8, for that Al—Cu—Mg—Ag alloy, shows the effect of cooling rate from ageing temperature on interrupt response, with the interrupt hold again at 25° C. FIG. 8 shows the effect of cooling rate from solution treatment temperature on low temperature interrupt response for Al-5.6Cu-0.45Mg-0.45Ag-0.3Mn-0.18Zr. Diamonds represent the response when the quench from the first ageing treatment temperature ($T_A$) was conducted into cooled quenchant, and triangles represent the interrupt response when the sample was naturally cooled in hot oil from the first ageing temperature.

FIG. 9, for Al—Cu—Mg—Ag alloy, exhibits the effect of the regression which may occur when reheating to the final ageing temperature T6 For this case, the time of the first ageing temperature during stage (a) and the typical hardness at the end of stage (a) are identical. More specifically, FIG. 9 shows the effect of slower quenching rate from the solution treatment temperature of 525° C. on alloy 5.6Cu-0.45Mg-0.45Ag-0.3Mn-0.18Zr. The material was quenched into room temperature tap water, aged 2 hours at 185° C., interrupt at 65° C. 7 days. When reheated at 185° C. (diamonds) the hardness regresses early, unlike the response shown in FIG. 6. In this case the higher properties are gained through the use of a re-ageing temperature of 150° C. (circles), which is then not affected by regression. Table 3 also shows a $T_C$ temperature of 150° C. instead of 185° C. is appropriate to achieve the maximum strengthening.

FIG. 10 corresponds to FIG. 2, but relates to alloy 2090. FIG. 10 shows comparison of T6 and T6I6 ageing curves for alloy 2090. The alloy was solution treated at 540° C. for 2 hours. The T6 ageing was at 185° C. For the T6I6 treatment, the alloy was aged at 185° C. for 8 hours, held at 65° C. for interrupt (inset plot), and reaged at 150° C.

FIG. 11 shows the T6I6 curve for alloy 8090. The alloy was solution treated for 2 hours at 540° C., quenched and aged at 185° C. for 7.5 hours, held at 65° C. for interrupt (inset plot), and reaged at 150° C.

FIG. 12 shows an example of the T9I6 curve for 8090, where cold work has been applied immediately following stage (b), and directly before stage (c), before continuing ageing according to the invention. Specifically, the alloy was aged for 8 hours at 185° C. quenched, cold worked 15%, held at 65° C. for interrupt (inset plot) and reaged at 150° C. Note here that the interrupt response was not as great as in the T6I6 condition shown in FIG. 11.

FIG. 13 shows an example comparison of T8 and T8I6 curves for alloy 8090, where the cold work has been applied immediately following solution treatment and quenching, but before any artificial ageing. For the T8 treatment, the alloy was solution treated at 560° C., quenched, and aged at 185° C. For the T8I6 treatment, the solution treated alloy was aged 10 minutes at 185° C., held at 65° C. for interrupt treatment (inset plot), and then reaged at 150° C.

Figure 14:
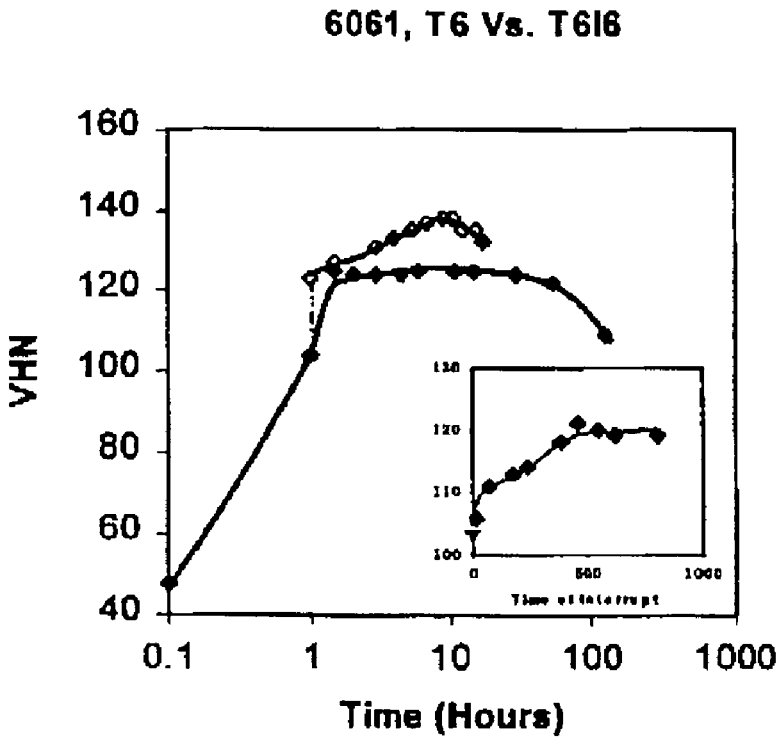
Figure 15:
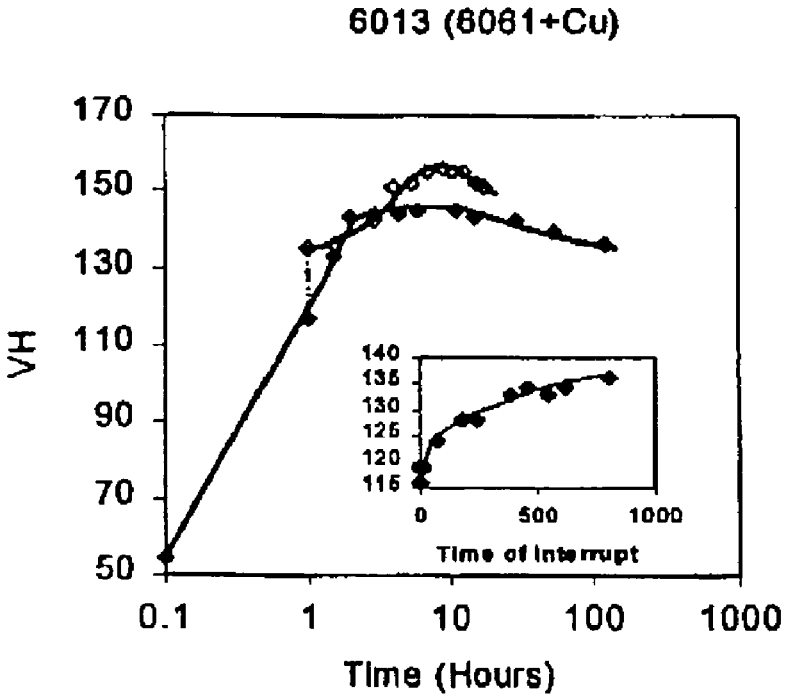
Figure 16:
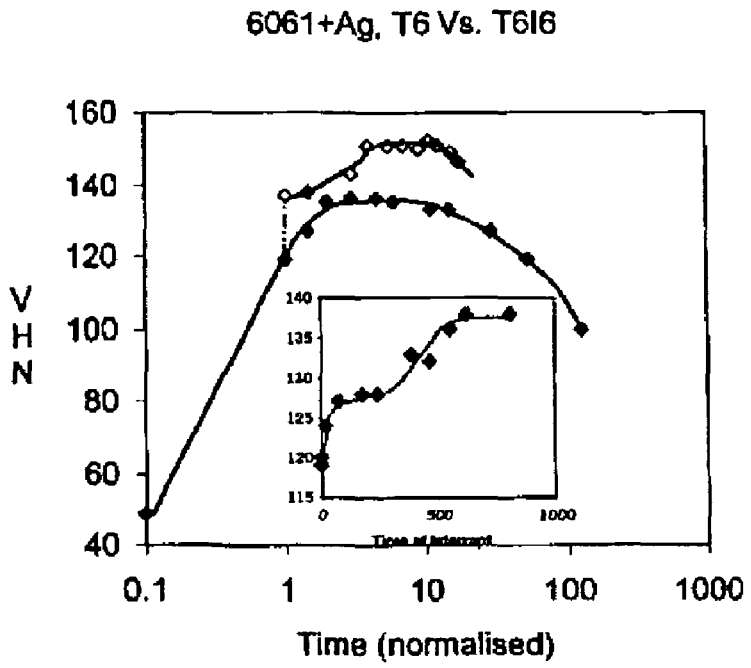
Figure 17:
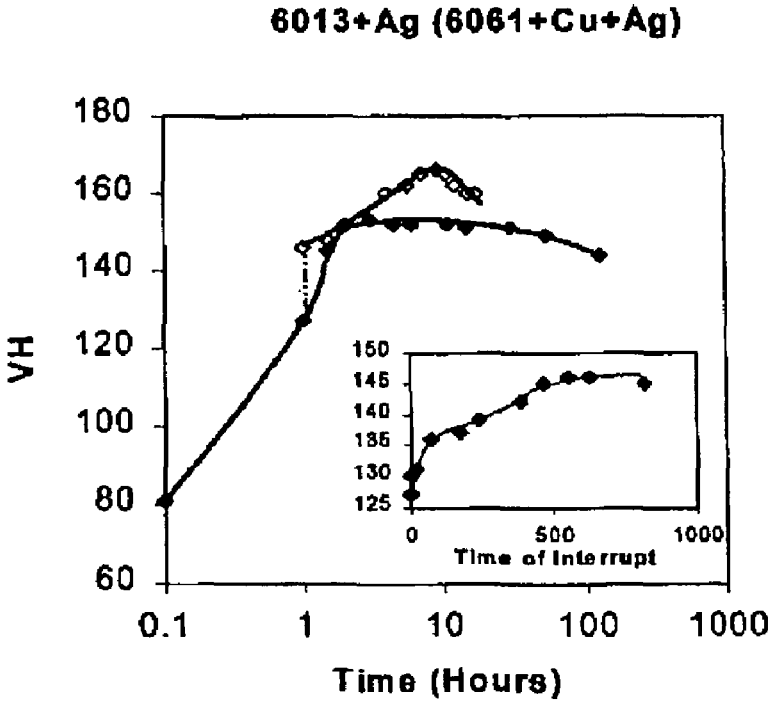

FIGS. 14 to 17 show example comparisons between the T6 hardness curves and the T6I6 hardness curves for alloys 6061, 6013, 6061+Ag, 6013+Ag respectively. In the case of FIG. 14, the alloy 6061 was solution treated for 1 hour at 540° C. T6 ageing (filled diamonds) was at 177° C.; while the T6I6 ageing (open diamonds) was at 177° C. for 1 hour, quenched, held at 65° C. for interrupt treatment, and reageing at 150° C. With FIG. 15, the alloy 6013 was solution treated for 1 hour at 540° C. T6 ageing (filled diamonds) was at 177° C. The T6I6 ageing (open diamonds) was at 177° C. for 1 hour, quenched, held at 65° C. for interrupt treatment, and re-ageing at 150° C. FIG. 15 also represents results obtainable with alloys 6056 and 6082 under similar T6I6 conditions due to compositional similarity. FIG. 16 shows results for alloy 6061+Ag, solution treated for 1 hour at 540° C. The T6 ageing (filled diamonds) was at 177° C. The T6I6 ageing (open diamonds) was at 177° C. for 1 hour, quenched, held at 65° C. for interrupt treatment, and re-ageing at 150° C. With FIG. 17, the results are for alloy 6013+Ag, solution treated for 1 hour at 540° C. The T6 ageing (filled diamonds) was at 177° C. The T6I6 ageing (open diamonds was at 177° C. for 1 hour, quenched, held at 65° C. for interrupt treatment, and reageing at 150° C.

FIG. 18 shows the T6I6 curve for 6061+20% SiC. This alloy was solution treated for 1 hour at 540° C. T6I6 ageing was at 177° C. for 1 hour, quenched, held at 65° C. for interrupt treatment, and re-ageing at 150° C.

FIGS. 19 to 22 show respective plots for the interrupt hold step of stage (c) for each of the alloys 6061, 6013, 6061+Ag, 6013+Ag, as a function of interrupt hold temperature, $T_B$. In each case, the respective alloy was aged 1 hour before the interrupt treatment at temperatures of 45° C. (asterisks), 65° C. (squares) and 80° C. (triangles).

FIG. 23 shows the effect of 25% cold work immediately after stage (b) before the interrupt on the interrupt step. The alloys to which FIG. 23 relates are 6061 (diamonds), 6061+Ag (squares), 6013 (triangles) and 6013+Ag (circles), with the interrupt hold temperature $T_B$ being 65° C. for the solid diamonds, squares, triangles and circles and 45° C. for those symbols shown in open form.

FIG. 24 shows examples of the T6I6 and T6I76 treatments, as applied to alloy 7050. In each case, the alloy was solution treated at 485° C., quenched, aged at 130° C., quenched with interrupt treatment at 65° C. (inset plot), then re-aged at 130° C. (diamonds) or at 160° C. (triangles). Note that the peak hardness for the T6 condition is 213 VHN.

FIGS. 25 and 26 show examples of the T6I6 heat treatments for the alloys 7075 and 7075+Ag (similar to alloy M-7009), respectively. Each alloy was solution treated at 485° C. for 1 hour, quenched, aged 0.5 hours at 130° C., with an interrupt at 35° C., and reaged at 100° C.

FIG. 27 shows the effect of temperature on the interrupt stage of the invention, respectively for each of 7075 and 7075+Ag. The upper plot relates to alloy 7075 and the lower plot relates to alloy 7075+Ag. In each case, a low temperature interrupt step was at 25° C. (diamonds), 45° C. (squares) or 65° C. (triangles). Note that with each alloy there is a difference in behaviour between 25° C. and the slightly higher interrupt temperatures of 45° C. and 65° C.

FIG. 28 shows an example comparison of T6 and T6I6 ageing curves, for an Al-8Zn-3Mg alloy with an interrupt hold at 35° C. The T6 temper was at 150° C. and is shown by filled diamonds while the T6I6 temper is shown by open diamonds. T6I6 alloy was solution treated at 480° C. for 1 hour, quenched, aged at 150° C. 20 minutes, quenched, interrupt treatment at 35° C. and reaged at 150° C. The inset plot shows the ageing response during the stage (c) interrupt hold.

FIG. 29 exhibits the T6I6 ageing curve for Al-6Zn-2Mg-0.5Ag alloy (interrupt hold at 35° C.), where the interrupt step is included in context in the plot of ageing on a linear time scale. In this case, the alloy was solution treated for 1 hour at 480° C., quenched, then aged for 45 minutes at 150° C., quenched, interrupt treatment at 35° C., and reaged at 150° C. The open squares represent the interrupt step.

FIGS. 30 and 31 exhibit example comparisons of the T6 and T6I6 ageing curves for each of the casting alloys 356 and 357. The alloy 356 to which FIG. 30 relates was solution treated at 520° C. for 24 hours and quenched. For the T6I6 treatment, the alloy was aged 3 hours at 177° C., quenched, interrupt treatment at 65° C., and reaged at 150° C. The alloy 356 was from a secondary aluminium billet, sand cast with no modifiers or chills. The alloy 357 alloy was solution treated at 545° C. for 16 hours, quenched into water at 65° C., and cooled quickly to room temperature. For the T6 treatment, the alloy 357 alloy was aged at 177° C. For the T6I6 temper, the alloy 357 was aged for 20 minutes at 177° C., quenched, interrupt treatment at 65° C., and reaged at 150° C. The alloy 357 was high quality permanent mould cast with chills and Sr modifier.

Table 4 provides an example of fracture toughness comparison values, comparing the T6 and T6I6 tempers of the various alloys.

TABLE 4

EXAMPLE COMPARISON OF FRACTURE TOUGHNESS FROM SELECT ALLOYS

| Alloy | T6 Fracture Toughness | T6I6 fracture toughness |
|---|---|---|
| 6061 (Note not plane strain) | 36.84 MPa√m | 58.43 MPa√m |
| 8090 | 24.16 MPa√m | 30.97 MPa√m |
| Al—5.6Cu—0.45Mg—0.45Ag—0.3Mn—0.18Zr | 23.4 MPa√m | 30.25 MPa√m |

Note all tests conducted in s-l orientation on samples tested according to ASTM standard E1304-89, "Standard Test Method for Plane Strain (Chevron Notch) Fracture Toughness of Metallic Materials"

FIGS. 32 and 33 exhibit example comparisons of the fracture toughness/damage tolerance behaviour for alloys 6061 and 8090 tested in the s-I orientation for each of the T6 and T6I6 conditions.

FIG. 34 exhibits an example comparison of the fatigue life of alloy 6061 aged to either the T6 or T6I6 tempers, which indicates that the fatigue life is not detrimentally affected by the increases in strength.

Finally, it is to be understood that various alterations, modifications and/or additions may be introduced into the constructions and arrangements of parts previously described without departing from the spirit or ambit of the invention.

What is claimed s:

1. A process for the heat treatment of an age-hardenable aluminium alloy which has alloying elements in solid solution, wherein the process includes the stages of:

(a) artificially ageing the alloy at an elevated temperature $T_A$, wherein the artificial ageing is conducted for a period sufficient to achieve strengthening of the alloy which corresponds to from 50% to 95% of the maximum strengthening obtainable by a full T6 temper for the alloy at the temperature $T_A$;

(b) quenching the alloy from the temperature $T_A$ at the end of the period for stage (a) to arrest primary precipitation of solute elements and to provide the alloy in an underaged condition;

(c) holding the quenched alloy at a temperature $T_B$ which is below the temperature $T_A$ and is in the range of from −10° C. to 120° C. to achieve secondary nucleation or continuing precipitation of solute elements; and (d) holding the alloy at a temperature $T_C$ in the range of($T_A$−50° C.) to ($T_A$+50° C.) for further artificial ageing of the alloy;

wherein the alloy is further strengthened by the combination of steps (c) and (d) to a level of substantially maximum strength which is in excess of the maximum strength obtainable for the alloy by the full T6 temper at temperature $T_A$.

2. The process of claim 1, wherein stages (c) and (d) are successive.

3. The process of claim 2, wherein there is little or no applied heating in stage (c).

4. The process of clam 1, wherein the alloy is subjected to mechanical deformation after solution treatment but before stage (a).

5. The process of claim 1, wherein the alloy is subjected to mechanical deformation after stage (b) but before stage (c).

6. The process of claim 1, wherein the alloy is subjected to mechanical deformation during stage (c).

7. The process of claim 4, wherein thermomechanical deformation is applied.

8. The process of claim 4, wherein the mechanical deformation is applied in conjunction to rapid cooling.

9. The process of claim 1, wherein the alloy is aged at $T_A$ directly after fabrication or casting with no discrete solution treatment stage.

10. The process of claim 1, wherein the final hardness is increased by at least 10 to 15%, relative to hardness levels obtainable with a conventional T6 heat treatment.

11. The process of claim 1, wherein the final yield strength (0.2% proof stress) is increased by at least 5 to 10%, relative to strength levels obtainable with a conventional T6 heat treatment.

12. The process of claim 1, wherein the tensile strength is increased by at least 5 to 10%, relative to strength levels obtainable with a conventional T6 heat treatment.

13. The process of claim 1, wherein the time at temperature $T_A$ is such as to achieve from about 85% to about 95% maximum strength obtainable by full conventional T6 ageing.

14. The process of claim 1, wherein the time at temperature $T_A$ is from several minutes to about 8 hours.

15. The process of claim 1, wherein the time at temperature $T_A$ is from 1 to 2 hours.

16. The process of claim 1, wherein the cooling of step (b) is by quenching into a fluid.

17. The process of claim 16, wherein a liquid is used as the quenching medium.

18. The process of claim 17, wherein cold water is used as the quenching medium.

19. The process of claim 15, wherein the quenching is to a temperature ranging from ambient temperature to about −10° C.

20. The process of claim 1, wherein the temperature $T_B$ is in the range of from about −10° C. to about 90° C.

21. The process of claim 1, wherein the period of time for stage (c) ranges from less than 8 hours up to in excess of 500 hours.

22. The process of claim 21, wherein the period of time for stage (c) ranges from about 8 hours to about 500 hours.

23. The process of claim 1, wherein the temperature $T_C$ in stage (d) is substantially the same as temperature $T_A$ in stage (a).

24. The process of claim 1, wherein the temperature $T_C$ used in stage (d) exceeds temperature $T_A$ in stage (a) by up to 50° C.

25. the process of claim 24, wherein the temperature $T_C$ exceeds temperature $T_A$ by up to about 20° C.

26. The process of claim 1, wherein the temperature $T_C$ used in stage (d) is lower than the temperature $T_A$ in stage (a) by 20° C. to 50° C.

27. The process of claim 26, wherein the temperature $T_C$ is lower than temperature $T_A$ by 30° C. to 50° C.

28. The process of claim 1, wherein the period of time at temperature $T_C$ during stage (d) is sufficient for achieving the desired level of additional strengthening.

29. A process for the heat treatment of an age-hardenable aluminium alloy which has alloying elements in solid solution, wherein the process includes the stages of:

(a) artificially ageing the alloy at an elevated temperature $T_A$, wherein the artificial ageing is conducted for a period sufficient to achieve strengthening of the alloy which corresponds to from 50% to 95% of the maximum strengthening obtainable by a full T6 temper for the alloy at the temperature $T_A$;

(b) quenching the alloy from the temperature $T_A$ at the end of the period for stage (a) to arrest primary precipitation of solute elements and to provide the alloy in an underaged condition;

(c) heating the quenched alloy to a final temperature $T_c$ through use of appropriately controlled heating cycles utilizing a slow heating rate, which provides for secondary nucleation or precipitation of solute element prior to attainment of the final temperature $T_C$, and holding at the final temperature $T_c$ for further artificial ageing of the alloy; said final temperature $T_c$ being in the range of ($T_A$+50° C.) to ($T_A$+50° C.); wherein the alloy is further strengthened by step (c) to a level of substantially maximum strength which is in excess of the maximum strength obtainable for the alloy by the full T6 temper at temperature $T_A$.

* * * * *